US011040555B2

(12) United States Patent
Murayama

(10) Patent No.: US 11,040,555 B2
(45) Date of Patent: Jun. 22, 2021

(54) PRINTING DEVICE CONFIGURED TO, WHEN HEADER PART OF OBJECT TO BE PRINTED DOES NOT MATCH ALREADY-PRINTED HEADER PART, PRINT HEADER PART AND BODY PART OF OBJECT AND CUT OFF ALREADY-PRINTED HEADER

(71) Applicant: BROTHER KOGYO KABUSHIKI KAISHA, Nagoya (JP)

(72) Inventor: Kentaro Murayama, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/791,741

(22) Filed: Feb. 14, 2020

(65) Prior Publication Data

US 2020/0269611 A1 Aug. 27, 2020

(30) Foreign Application Priority Data

Feb. 21, 2019 (JP) ..... JP2019-028986

(51) Int. Cl.
*B41J 11/70* (2006.01)
*B41J 11/66* (2006.01)

(52) U.S. Cl.
CPC ..... *B41J 11/70* (2013.01); *B41J 11/663* (2013.01)

(58) Field of Classification Search
CPC ..... B41J 11/70; B41J 11/663; B41J 11/703
USPC ..... 347/218
See application file for complete search history.

(56) References Cited

U.S. PATENT DOCUMENTS

2012/0274953 A1* 11/2012 Makabe ..... B41J 11/42 358/1.5
2013/0003097 A1* 1/2013 Yokoyama ..... G06K 15/1822 358/1.13
2018/0015749 A1* 1/2018 Inoue ..... B41J 3/4075

FOREIGN PATENT DOCUMENTS

JP H07-205529 A 8/1995
JP 2004-114550 A 4/2004
JP 2005-96103 A 4/2005
JP 2017-24329 A 2/2017

* cited by examiner

*Primary Examiner* — Huan H Tran
*Assistant Examiner* — Alexander D Shenderov
(74) *Attorney, Agent, or Firm* — Kenealy Vaidya LLP

(57) ABSTRACT

A printing device configured to perform: printing a first body part of a first object on a first portion of a printing medium; after printing the first body part, printing a specific header part which is the same as a first header part of the first object on a second portion positioned upstream of the first portion; after printing the specific header part, acquiring a second object including a second header part and a second body part; determining whether the first header part and the second header part match; when determining that the two header parts do not match, printing the second header part on a third portion positioned upstream of the second portion; and cutting an upstream end of the second portion; and when determining that the two header parts match, printing the second body part on the third portion without printing the second header part.

5 Claims, 16 Drawing Sheets

DOWNSTREAM
UPSTREAM
17
L
10
50
5A

81
WORK DATE
19/01/09
71A 71 (7)
WIRE A → WIRE B
71A (7A)
71B (7B)

72
82
71
71B
72A

5B

DOWNSTREAM
UPSTREAM
17
L
10
50
WORK DATE
19/01/09
74A 74
50
WORK DATE
19/01/09
WIRE A → WIRE B
74A
74B 74
75
50
85
WORK DATE
19/01/09
WIRE A → WIRE B
WORK DATE
19/01/09
74A
74B
75A 5D
74
75
50
WORK DATE
19/01/09
WIRE A → WIRE B
WORK DATE
19/01/09
74A
74B
75A

DOWNSTREAM
UPSTREAM
17
L
10
50
WORK DATE
19/01/09
74A

86
WORK DATE
19/01/09
WORK DATE
19/01/10
74A
76A

WORK DATE
19/01/09
74A
WORK DATE
19/01/10
76A

76
WORK DATE
19/01/10
WIRE A → WIRE B
76A
76B 76
87
77
WORK DATE
19/01/10
WIRE A → WIRE B
WORK DATE
19/01/10
76A
76B
77A

5E
WORK DATE
19/01/10
WIRE A → WIRE B
76A
76B
WORK DATE
19/01/10
77A

FIG. 10

95A 951 96A 952 96B 96C

| FLAG | | | | PRINTING SETTINGS | NUMBER OF CUTTING OPERATIONS | CUTTING SETTINGS | | |
|---|---|---|---|---|---|---|---|---|
| | | | | | | NECESSITY OF CUTTING | | |
| FIRST | SECOND | THIRD | FOURTH | | | | | |
| NECESSITY OF HEADER PART | HEADER PART HAS BEEN PRINTED IN PREVIOUS JOB ? | CONTENTS OF TWO HEADER PARTS MATCH ? | NECESSITY OF CUTTING BETWEEN HEADER PART AND BODY PART | NECESSITY OF PRINTING OF HEADER PART | | BETWEEN TWO HEADER PARTS | BETWEEN HEADER PART AND BODY PART | BETWEEN BODY PART AND SPECIFIC HEADER PART |
| 1 : NECESSARY<br>0 : UNNECESSARY | 1 : PRINTED<br>0 : NOT PRINTED | 1: MATCH<br>0: DIFFER | 1 : NECESSARY<br>0 : UNNECESSARY | 1 : NECESSARY<br>0 : UNNECESSARY | | 1 : NECESSARY<br>0 : UNNECESSARY | 1 : NECESSARY<br>0 : UNNECESSARY | 1 : NECESSARY<br>0 : UNNECESSARY |
| 1 | 1 | 1 | 1 | 0 | 2 | 0 | 1 | 1 |
| | | | 0 | 0 (W2) | 1 | 0 | 0 | 1 |
| | | 0 | 1 | 1 | 3 | 1 | 1 | 1 |
| | | | 0 | 1 (W3) | 2 (W4) | 1 | 0 | 1 |
| | 0 | 1 | 1 | 1 | 2 | 0 | 1 | 1 |
| | | | 0 | 1 | 1 | 0 | 0 | 1 |
| | | 0 | 1 | 1 | 2 | 0 | 1 (W5) | 1 |
| | | | 0 | 1 (W1) | 1 | 0 | 0 | 1 |
| 0 | 1 | 1 | 1 | 0 | 2 | – | 1 | 1 |
| | | | 0 | 0 | 1 | – | 0 | 1 |
| | | 0 | 1 | 0 | 2 | – | 1 | 1 |
| | | | 0 | 0 | 1 | – | 0 | 1 |
| | 0 | 1 | 1 | 0 | 2 | – | 1 | 1 |
| | | | 0 | 0 | 1 | – | 0 | 1 |
| | | 0 | 1 | 0 | 2 | – | 1 | 1 |
| | | | 0 | 0 | 1 | – | 0 | 1 |

DOWNSTREAM
UPSTREAM 50
10
17
L
174A
175B
175
176B
176
177B
177
178A
188
105A
WORK DATE 19/01/09
WIRE A → WIRE B

DOWNSTREAM
UPSTREAM 50
10
17
L
276
276B
275
275B
275A
WIRE A → WIRE B
WORK DATE 19/01/10
277
277B
278A
288
205A

PRINTING DEVICE CONFIGURED TO, WHEN HEADER PART OF OBJECT TO BE PRINTED DOES NOT MATCH ALREADY-PRINTED HEADER PART, PRINT HEADER PART AND BODY PART OF OBJECT AND CUT OFF ALREADY-PRINTED HEADER

CROSS REFERENCE TO RELATED APPLICATION

This application claims priority from Japanese Patent Application No. 2019-028986 filed Feb. 21, 2019. The entire content of the priority application is incorporated herein by reference.

TECHNICAL FIELD

The present disclosure relates to a printing device.

BACKGROUND

Printing devices that print on a long printing medium while the printing medium is being conveyed are well known in the art. One such conventional printing device has a printing portion and a cutting portion that are separated from each other in the conveying direction that the printing medium is conveyed. Owing to this separation, a margin area in which no printing is performed may be formed on the printing medium. Techniques have been proposed for making effective use of margin areas on the printing medium. Japanese Patent Application Publication No. 2005-096103 describes a tape printing device provided with a thermal head and a full cutter part. The full cutter part is positioned downstream of the thermal head in the conveying direction of the tape. During a period of time from a time when a print of normal print data has been completed by the thermal head to a time when the trailing end of the printed normal print data has passed the full cutter part, the tape printing device prints margin print data relevant to normal print data to be printed next on the tape being passing the thermal head. With this technique, the tape printing device suppresses a margin area from being formed on the tape.

SUMMARY

However, there may be instances in which printing with the printing devices is interrupted and a different user subsequently resumes printing on the printing device. In such cases, the second user may not necessarily need the margin print data already printed on the tape when the second user resumes use of the printing device. Consequently, when the second user decides that the printed margin print data is not needed, the second user must perform a tedious operation to cut off the section of tape having the margin print data.

In view of the foregoing, it is an object of the present disclosure to provide a printing device that can effectively utilize margin areas on a printing medium while simplifying the user's operations for cases in which the margin print data differs from the data that the user wishes to print.

In order to attain the above and other objects, according to one aspect, the disclosure provides a printing device including a conveying portion, a printing portion, a cutting portion, and a controller. The conveying portion is configured to convey a printing medium along a conveying path in a conveying direction. The printing portion is configured to print objects on the printing medium conveyed along the conveying path in the conveying direction by the conveying portion. The cutting portion is configured to cut the printing medium. The cutting portion is separated from the printing portion and disposed downstream of the printing portion in the conveying direction. The controller is configured to perform: acquiring a first object including a first header part and a first body part; printing, using the printing portion, the first body part on a first portion of the printing medium; after completing the printing the first body part, conveying, using the conveying portion, the printing medium until an upstream end of the first portion in the conveying direction reaches the cutting portion; while performing the conveying the printing medium, printing, using the printing portion, a specific header part on a second portion of the printing medium, the specific header part being the same as the first header part, the second portion being positioned upstream of the first portion in the conveying direction; after completing the printing the specific header part, acquiring a second object including a second header part and a second body part; determining whether the first header part and the second header part match each other, in response to determining that the first header part and the second header part do not match, printing, using the printing portion, the second header part on a third portion of the printing medium, the third portion being positioned upstream of the second portion in the conveying direction; and cutting, using the cutting portion, an upstream end of the second portion in the conveying direction; and in response to determining that the first header part and the second header part match each other, printing, using the printing portion, the second body part on the third portion of the printing medium without printing the second header part.

BRIEF DESCRIPTION OF THE DRAWINGS

The particular features and advantages of the embodiment(s) as well as other objects will become apparent from the following description taken in connection with the accompanying drawings, in which:

FIG. 10 is a view illustrating a table 95A used in the printing process executed in the printing device 1 according to the embodiment;

DETAILED DESCRIPTION

<Overview of a Printing Device 1>

Figure 1:
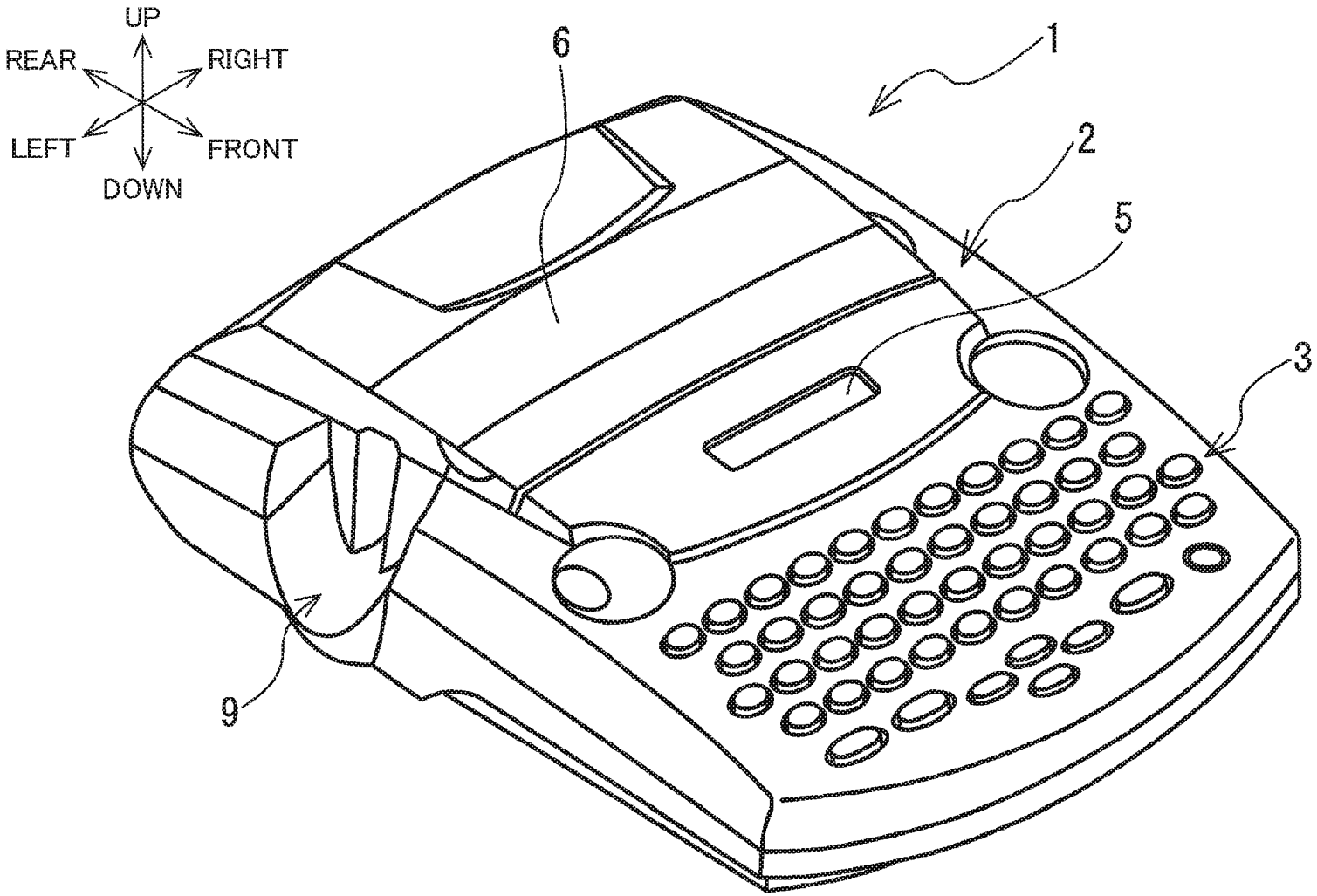
FIG. 1 is a perspective view of a printing device 1 according to one embodiment of the present disclosure.
Figure 2:
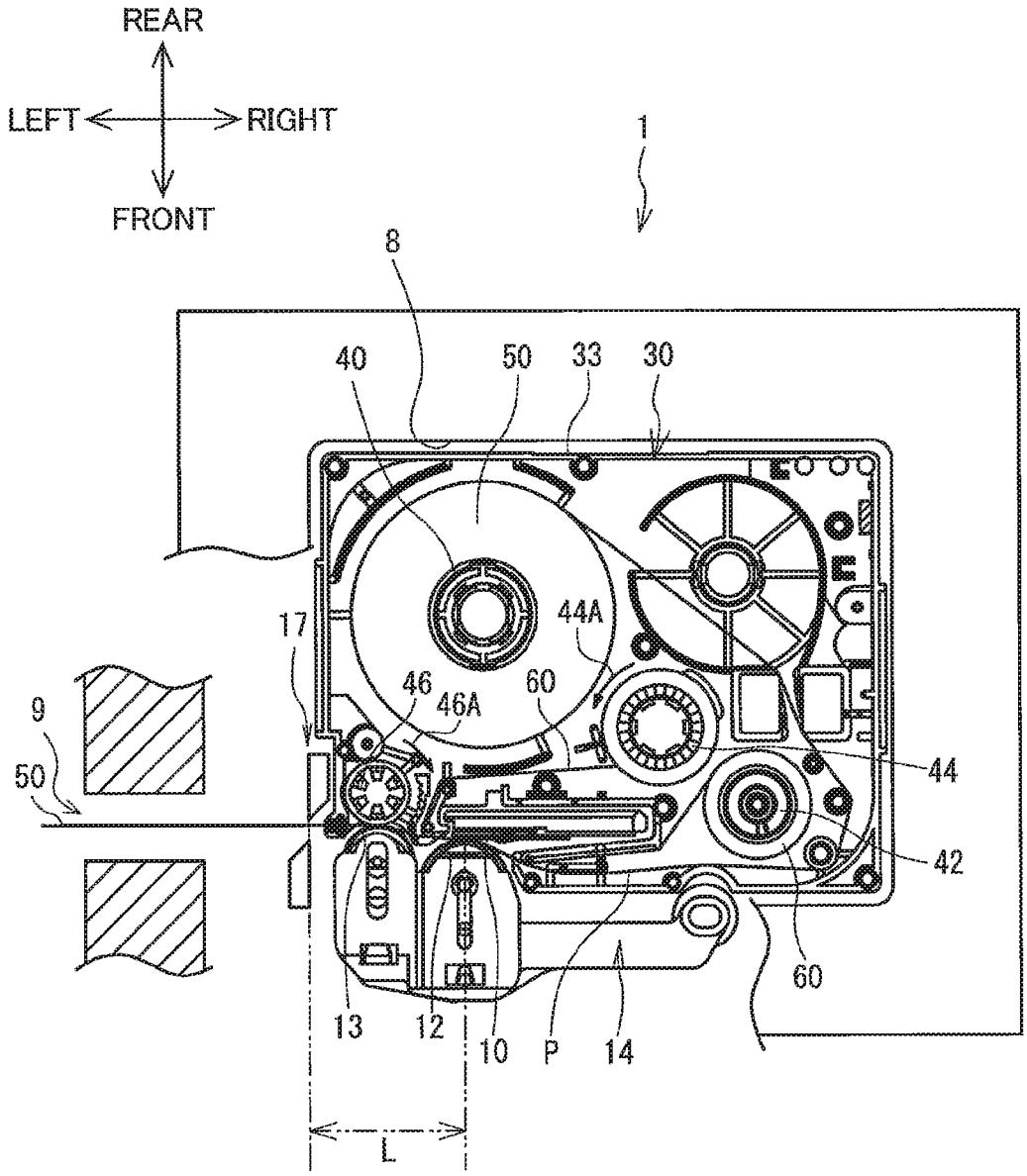
FIG. 2 is a plan view of the printing device 1 according to the embodiment and schematically illustrates an internal structure of the printing device 1.

Next, one embodiment of the present disclosure will be described while referring to FIGS. 1 through 11. FIG. 1 is a perspective view of a printing device 1 according to the present embodiment. FIG. 2 is a plan view of the printing device 1 and schematically illustrates the internal structure of the printing device 1. The printing device 1 can create labels by printing objects on a tape 50 (see FIG. 2) that is a printing medium. Examples of the objects include letters, symbols, numbers, and other characters and character strings, as well as graphics and emojis. In the following description, the upper-right side, the lower-left side, lower-right side, upper-left side, top side, and bottom side in FIG. 1 will define the right side, left side, front side, rear side, top side, and bottom side of the printing device 1, respectively.

As shown in FIG. 1, the printing device 1 is provided with a body cover 2. The body cover 2 is the housing of the printing device 1 and has a rectangular parallelepiped shape. A keyboard 3 for inputting character strings and the like is disposed on the top surface of the body cover 2 in the front portion thereof. The keyboard 3 includes a power switch, function keys, arrow keys, and the like. A display 5 is provided in the top surface of the body cover 2 to the rear side of the keyboard 3. The display 5 displays various information. The display 5 may be a dot matrix LCD, for example. A cassette cover 6 is provided on the rear side of the display 5. The cassette cover 6 can be opened and closed relative to the body cover 2. A discharge opening 9 is formed in the rear portion of the left side surface of the body cover 2. A printed section of the tape 50 is discharged from the body cover 2 through the discharge opening 9.

As shown in FIG. 2, a cassette mounting section 8 is provided inside the body cover 2 below the cassette cover 6 (see FIG. 1). The cassette mounting section 8 is a recessed part having a shape that corresponds to the shape of a tape cassette 30. The tape cassette 30 can be mounted in and removed from the cassette mounting section 8. The printing device 1 prints character strings and the like inputted via the keyboard 3 using the tape cassette 30 mounted in the cassette mounting section 8.

The tape cassette 30 is provided with a box-shaped cassette case 33 for accommodating a tape 50, an ink ribbon 60, and the like. The tape 50 is formed of a base material and a release paper. The release paper is bonded to the base material with adhesive and laminated on one side surface of the base material. The unprinted tape 50 is wound around a tape spool 40. The tape spool 40 is rotatably supported in the left-rear section of the cassette case 33. The unused ink ribbon 60 is wound about a ribbon spool 42. The ribbon spool 42 is rotatably supported in the right-front section of the cassette case 33. The ink ribbon 60 and tape 50 have equivalent widths. A ribbon take-up spool 44 is rotatably supported in the cassette case 33 between the tape spool 40 and ribbon spool 42. The ribbon take-up spool 44 draws the unused ink ribbon 60 off the ribbon spool 42 and takes up the ink ribbon 60 after the ink ribbon 60 has been used for printing. A tape drive roller 46 is rotatably supported in the left-front corner of the cassette case 33. The tape drive roller 46 draws the unprinted tape 50 off the tape spool 40. The tape drive roller 46 is an example of the claimed "conveying portion." The tape 50 is an example of the claimed "printing medium."

Also provided in the cassette mounting section 8 are a ribbon take-up shaft (not shown), a tape drive shaft (not shown), a thermal head 10, a retaining arm 14, and the like. The ribbon take-up shaft is inserted into the ribbon take-up spool 44 and is rotated by the drive of a tape feed motor 23 (see FIG. 3). The tape drive shaft is inserted into the tape drive roller 46 and is rotated through a transmission mechanism (not shown) by the drive of the tape feed motor 23. The thermal head 10 is disposed on the right side of the tape drive shaft. The printing device 1 prints on the tape 50 using the unused ink ribbon 60 by heating the thermal head 10. The thermal head 10 is an example of the claimed "printing portion."

The retaining arm 14 extends in the left-right direction and is pivotably supported on its right end. The retaining arm 14 pivots in association with the opening/closing of the cassette cover 6. Specifically, the retaining arm 14 can pivot between a printing position (see FIG. 2) in which the left end of the retaining arm 14 has been moved rearward, and a retracted position in which the left end of the retaining arm 14 has been moved forward. The retaining arm 14 rotatably supports a platen roller 12 and a pinch roller 13. When the retaining arm 14 is disposed in the printing position, the platen roller 12 presses the tape 50 and ink ribbon 60 against the thermal head 10, whereby the tape 50 and ink ribbon 60 are brought into pressure contact with each other. The pinch roller 13 and the tape drive roller 46 pinch the tape 50 therebetween.

A cutting part 17 is disposed near the discharge opening 9. The cutting part 17 cuts the tape 50 at a prescribed position by the drive of a cutting motor 24 (see FIG. 3). The cutting part 17 can selectively execute a full cut or a half cut. A full cut is a cutting method of cutting through both the base material and release paper of the tape 50 in the thickness direction across the entire width thereof. A half cut is a cutting method of cutting only through the base material of the tape 50 in the thickness direction across the entire width thereof, while not cutting through the release paper. The cutting part 17 is an example of the claimed "cutting portion."

<Electrical Configuration of the Printing Device 1>

Figure 3:
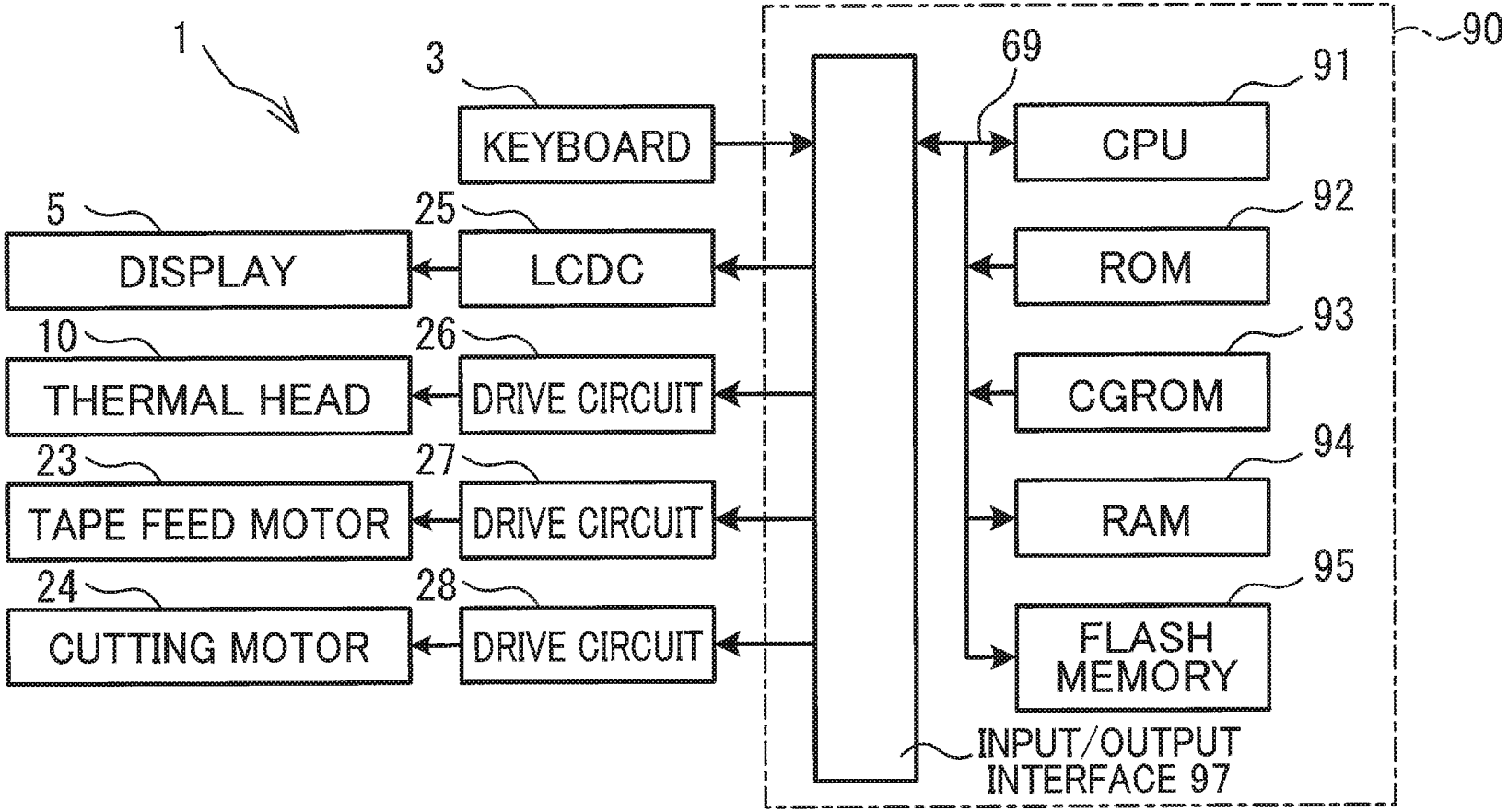
FIG. 3 is a block diagram illustrating an electrical configuration of the printing device 1 according to the embodiment.

Next, the electrical configuration of the printing device 1 will be described with reference to FIG. 3. FIG. 3 is a block diagram illustrating the electrical configuration of the printing device 1. The printing device 1 is provided with a control circuit unit 90. The control circuit unit 90 is provided with a CPU 91, a ROM 92, a character generator ROM (CGROM) 93, a RAM 94, a flash memory 95, and an input/output interface 97, all of which components are connected via a data bus 69. The CPU 91 performs overall control of the printing device 1. The ROM 92 stores various parameters required when the CPU 91 executes various programs. The CGROM 93 stores built-in fonts and the like. The RAM 94 includes a text memory and a print buffer, and stores first through fourth flags described later (see FIG. 8) and other data. The flash memory 95 stores various programs and the like that the CPU 91 executes. The CPU 91 is an example of the claimed "controller."

The input/output interface 97 is connected to the keyboard 3, a liquid crystal drive circuit (LCDC) 25, and drive circuits 26, 27, and 28. The LCDC 25 has video RAM (not shown) for outputting display data to the display 5. The drive circuit 26 is an electronic circuit for driving the thermal head 10. The drive circuit 27 is an electronic circuit for driving the tape feed motor 23. The drive circuit 28 is an electronic circuit for driving the cutting motor 24.

<Overview of a Printing Operation>

The operator inserts the tape cassette 30 into the cassette mounting section 8 and then closes the body cover 2 (i.e., closes the cassette cover 6). Through this operation, the retaining arm 14 moves from the retracted position to the printing position. At this time, the platen roller 12 and the thermal head 10 pinch the tape 50 and ink ribbon 60 between the platen roller 12 and the thermal head 10; the ink ribbon 60 is interposed between the tape 50 and the thermal head 10; and the pinch roller 13 and the tape drive roller 46 pinch the tape 50 between the pinch roller 13 and the tape drive roller 46.

The CPU 91 drives the tape feed motor 23 via the drive circuit 27. Through this action, the ribbon take-up shaft and tape drive shaft rotate in association with each other. The ribbon take-up shaft rotates the ribbon take-up spool 44 in the direction of an arrow 44A shown in FIG. 2. At this time, the ink ribbon 60 is paid out from the ribbon spool 42. Additionally, the tape drive shaft rotates the tape drive roller 46 in the direction of an arrow 46A shown in FIG. 2. At this time, the tape 50 is paid out from the tape spool 40 and conveyed along a prescribed conveying path P. Hereinafter, the direction in which the tape 50 is conveyed along the conveying path P will be called the conveying direction. The side of the conveying path P near the tape spool 40 will be called the upstream side in the conveying direction, and the side of the conveying path P opposite the upstream side will be called the downstream side.

The platen roller 12 rotates in response to the tape 50 being conveyed by the tape drive roller 46. The platen roller 12 presses the tape 50 paid out from the tape spool 40 against the thermal head 10. The CPU 91 supplies electric power to a plurality of heating elements in the thermal head 10, causing the heating elements to generate heat. The heat generated by the heating elements transfers ink from the ink ribbon 60 to the tape 50. In the following description, "the heating elements in the thermal head 10 generates heat by being supplied with electric power" will be described as "the thermal head 10 is heated". Ink in the ink ribbon 60 is repeatedly transferred onto the tape 50 as the tape 50 is conveyed along the conveying path P from the upstream side toward the downstream side by the tape drive roller 46. Through this transfer of ink, objects are printed on the tape 50.

The pinch roller 13 rotates in response to the tape 50 being conveyed by the tape drive roller 46. The tape drive roller 46 and pinch roller 13 convey the tape 50 on which objects have been printed toward the discharge opening 9 disposed downstream in the conveying direction. The cutting part 17 is disposed at a position separated downstream of the thermal head 10 and tape drive roller 46 in the conveying direction. More specifically, the cutting part 17 is disposed at a position separated downstream from the thermal head 10 by a distance L. The CPU 91 drives the cutting motor 24 via the drive circuit 28. The cutting part 17 performs a full cut through the tape 50 to cut off the portion of the tape 50 having objects printed thereon, thereby detaching the printed portion of the tape 50 from the remaining tape 50 in the tape cassette 30. The portion of the tape 50 which has objects printed thereon and has been cut off from the remaining tape 50 in the tape cassette 30 corresponds to a label. The label is discharged through the discharge opening 9. The used ink ribbon 60 is taken up on the ribbon take-up spool 44.

<Detailed Description of the Printing Operation>

Figures 4A, 4B, 4C, 4D, 4E, 4F:
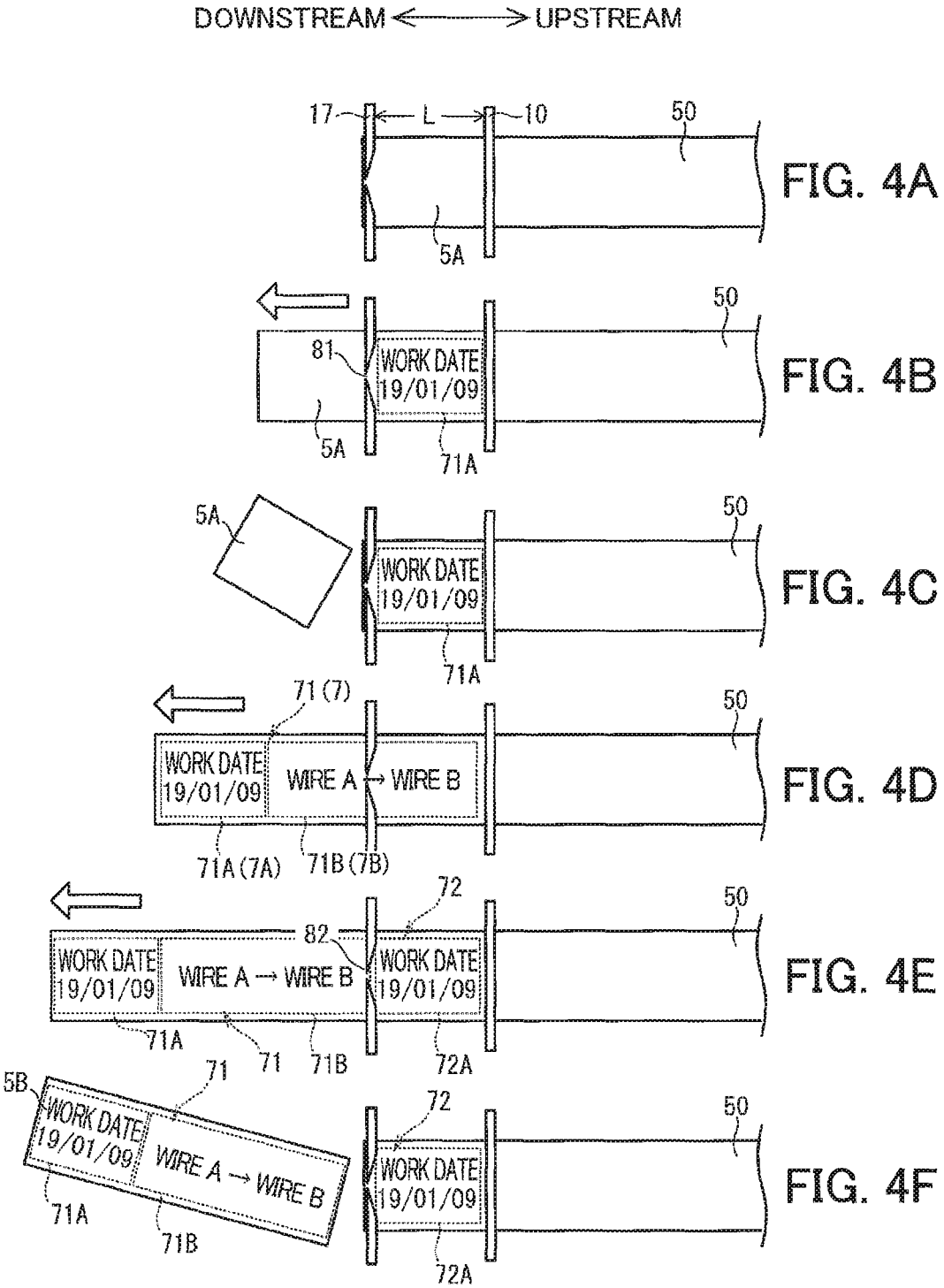
FIG. 4A is a view for describing a first example of a label creating method in the printing device 1 according to the embodiment, and illustrates a state in which a margin area 5A is positioned between a thermal head 10 and a cutting part 17 of the printing device 1 at the start time of a job.
FIG. 4B is a view for describing the first example of the label creating method in the printing device 1 according to the embodiment, and illustrates a state in which printing of a header part 71A is completed and a border area 81 between the margin area 5A and the header part 71A is aligned with the cutting part 17.
FIG. 4C is a view for describing the first example of the label creating method in the printing device 1 according to the embodiment, and illustrates a state in which cutting of the border area 81 is completed.
FIG. 4D is a view for describing the first example of the label creating method in the printing device 1 according to the embodiment, and illustrates a state in which printing of a body part 71B is completed.
FIG. 4E is a view for describing the first example of the label creating method in the printing device 1 according to the embodiment, and illustrates a state in which printing of a header part 72A is completed and a border area 82 between the body part 71B and the header part 72A is aligned with the cutting part 17.
FIG. 4F is a view for describing the first example of the label creating method in the printing device 1, and illustrates a state in which cutting of the border area 82 is completed.

Next, a printing operation performed by the printing device 1 will be described in detail with reference to FIGS. 4A through 7F. As shown in FIG. 4D, the printing device 1 repeatedly prints an object 7 (an object 71, 72, etc.) having a header part 7A and a body part 7B.

The header part 7A and body part 7B are juxtaposed in the conveying direction. The header part 7A includes the information for the print date of the object 7, e.g., "WORK DATE: 19/01/09". The body part 7B includes the information related to specific content of the object 7, e.g., "WIRE A→WIRE B". The header part 7A is disposed downstream of the body part 7B in the conveying direction. The length of the body part 7B in the conveying direction is longer than the length of the header part 7A in the conveying direction. To simplify the description, the present embodiment will presume that the length of the header part 7A in the conveying direction is equivalent to the distance L in the conveying direction between the thermal head 10 and cutting part 17 of the printing device 1. However, the present disclosure may be applied to cases in which the length of the header part 7A in the conveying direction differs from the distance L.

When a print command is inputted via the keyboard 3 (see FIG. 1) after contents of the object 7 (i.e., contents of the header part 7A and the body part 7B) and a print count for the object 7 (hereinafter a "specified number of times") is specified via the keyboard 3 (see FIG. 1), the printing device 1 begins a first printing operation for repeatedly printing the object 7 the specified number of times. The printing device 1 ends the first printing operation after the object 7 has been printed the specified number of times. After ending the first printing operation, the printing device 1 begins a second printing operation for printing a specific header part that is the same as the header part 7A of the object 7 (i.e., that has the same information as that of the header part 7A). The printing device 1 ends the second printing operation after the specific header part has been printed. In the following description, a set of the first printing operation and the second printing operation performed after the first printing operation will be called a "job." In a case where a job is repeatedly executed by repeatedly inputting a print command, the successive jobs are given the notation Job(1), Job(2), . . . .

Here, a series of operations performed by the user for instructing the printing device 1 to print the object 7 will be described. First, the user operates the keyboard 3 to input a desired character string (e.g., "WORK DATE: 19/01/09") as content of the header part 7A and a desired character string (e.g., "WIRE A→WIRE B") as content of the body part 7B. Next, the user inputs a desired print count as the specified number of times via the keyboard 3. Finally, the user presses a print start button provided on the keyboard 3 to input a print command, thereby causing the printing device 1 to start the printing operation described above. Note that the CPU 91 stores in the text memory the character string inputted for the header part 7A and the character string inputted for the body part 7B as first text information and second text information, respectively. The first text information is information indicating the character string specified by the user as content of the header part 7A. The second text information is information indicating the character string specified by the use as content of the body part 7A. Also, the CPU 91 stores in a storage area of the RAM 94 the desired print count specified by the user as the specified number of times.

As shown in FIG. 4A, the tape 50 may have an unprinted portion between the thermal head 10 and the cutting part 17 (hereinafter called a "margin area 5A") when the printing device 1 begins Job(1). The thermal head 10 cannot print on the margin area 5A of the tape 50 unless the tape 50 is conveyed upstream in the conveying direction. Accordingly, the printing device 1 executes Job(1) as described below so that the margin area 5A is not included at the head of the label created by printing the object 7.

The printing device 1 heats the thermal head 10 while conveying the tape 50 downstream in the conveying direction. Through this action, a header part 71A of the object 71 is printed on the tape 50, as illustrated in FIG. 4B. More specifically, the header part 71A is printed on a portion upstream of the margin area 5A of the tape 50.

At the timing that printing of the header part 71A is completed, the tape 50 has been conveyed the distance L downstream since the header part 71A has a length in the conveying direction equivalent to the distance L. At this time, the upstream end of the margin area 5A and the downstream end of the portion of the tape 50 in which the header part 71A has been printed (hereinafter called a border area 81 between the margin area 5A and header part 71A) are aligned with the position of the cutting part 17. Therefore, the printing device 1 halts conveyance of the tape 50 and controls the cutting part 17 to perform a full cut at the border area 81 of the tape 50. Consequently, the margin area 5A of the tape 50 is cut off from the tape cassette 30, as illustrated in FIG. 4C.

Subsequently, the printing device 1 resumes conveying the tape 50 downstream in the conveying direction. While conveying the tape 50 downstream, the printing device 1 heats the thermal head 10. Through this action, the printing device 1 prints a body part 71B of the object 71 on the tape 50, as illustrated in FIG. 4D. More specifically, the body part 71B is printed on a portion upstream of the portion in which the header part 71A has been printed.

After completing printing of the body part 71B, the printing device 1 heats the thermal head 10 and prints a header part 72A of the next object 72 on the tape 50 while continuing to convey the tape 50 downstream, as illustrated in FIG. 4E. More specifically, the header part 72A is printed on a portion upstream of the portion in which the body part 71B has been printed. In other words, the header part 72A is printed on a portion upstream of the portion in which the object 71 has been printed.

At the timing that printing of the header part 72A is completed, the upstream end of the portion of the tape 50 in which the body part 71B of the object 71 has been printed and the downstream end of the portion of the tape 50 in which the header part 72A of the object 72 has been printed (hereinafter called a border area 82 between the body part 71B and header part 72A) are aligned with the position of the cutting part 17. At this time, the printing device 1 halts conveyance of the tape 50 and controls the cutting part 17 to perform a full cut at the border area 82 of the tape 50. Consequently, the portion of the tape 50 in which the object 71 has been printed is cut off from the tape cassette 30, as illustrated in FIG. 4F. The above process creates a label 5B in which the object 71 has been printed.

Figure 5A:
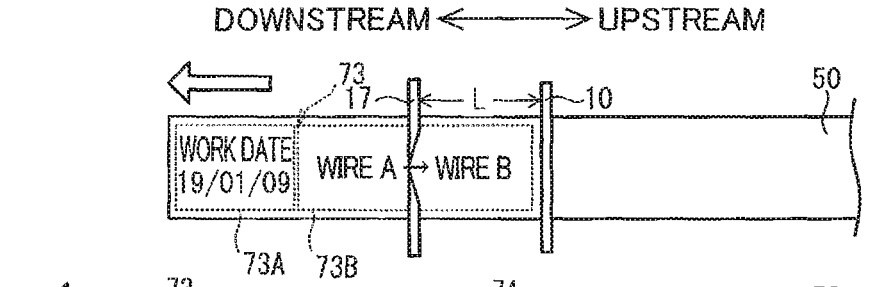
FIG. 5A is a view for describing the first example of the label creating method in the printing device 1 according to the embodiment, and illustrates a state in which printing of a body part 73B is completed.
Figure 5B:
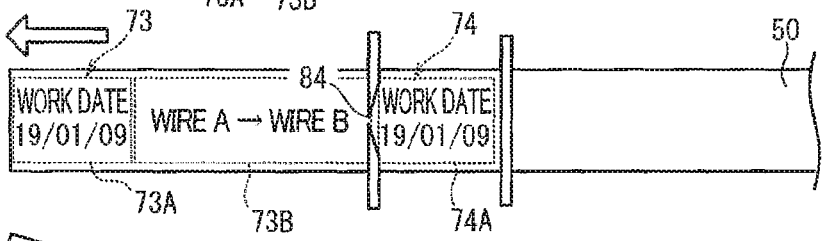
FIG. 5B is a view for describing the first example of the label creating method in the printing device 1 according to the embodiment, and illustrates a state in which printing of a header part 74A (i.e., a specific header part) is completed and a border area 84 between the body part 73B and the header part 74A is aligned with the cutting part 17.

The printing device 1 repeatedly performs the printing operation for the object 7 described above the specified number of times. FIG. 5A shows the state of the tape 50 just after the printing operation for the object 7 has been performed the specified number of times, i.e., the state of the tape 50 just after the first printing operation has been completed. From this point, the printing device 1 starts the second printing operation. After starting the second printing operation, the printing device 1 heats the thermal head 10 and prints a header part 74A that is a specific header part on the tape 50 while continuing to convey the tape 50 a further distance L, as illustrated in FIG. 5B. More specifically, the header part 74A (i.e., the specific header part in Job(1)) is printed on a portion upstream of the portion in which a body part 73B has been printed. That is, the header part 74A (i.e., the specific header part in Job(1)) is printed on the portion upstream of the portion in which an object 73 (i.e., the last object in Job(1)) including a header part 73A and the body part 73B has been printed. The object 73 is an example of the claimed "first object." The header part 73A is an example of the claimed "first header part." The print date "19/01/09" included in the header part 73A is an example of the claimed "first print date." The body part 73B is an example of the claimed "first body part." The portion in which the body part 73B has been printed is an example of the claimed "first portion." The header part 74A is an example of the claimed "specific header part." The portion in which the header part 74A has been printed is an example of the claimed "second portion."

Figure 5C:
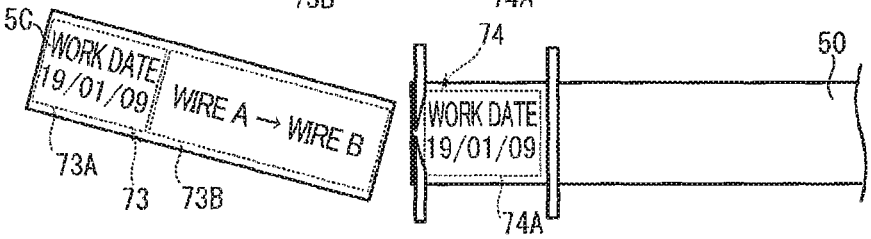
FIG. 5C is a view for describing the first example of the label creating method in the printing device 1 according to the embodiment, and illustrates a state in which cutting of the border area 84 is completed.

At the timing that printing of the header part 74A (i.e., the specific header part in Job(1)) is completed, the upstream end of the portion of the tape 50 in which the body part 73B of the object 73 has been printed and the downstream end of the portion in which the header part 74A has been printed (hereinafter called a border area 84 between the body part 73B and header part 74A) are aligned with the position of the cutting part 17. Thus, the printing device 1 halts conveyance of the tape 50 and controls the cutting part 17 to perform a full cut at the border area 84 of the tape 50, as illustrated in FIG. 5C. Through this action, the portion of the tape 50 in which the object 73 has been printed is cut off from the tape cassette 30. These operations create a label 5C in which the object 73 is printed. Further, the portion of the tape 50 in which the header part 74A has been printed is disposed or left between the thermal head 10 and the cutting part 17.

In the operation described above, in order to create the label 5C, the printing device 1 needs to cut through the upstream end of the portion of the tape 50 in which the last object in Job(1), i.e., the object 73 has been printed. Accordingly, after the body part 73B of the last object 73 in Job(1) has been printed (i.e., after the first printing operation has been completed), the printing device 1 needs to convey the tape 50 downstream until the upstream end of the portion in which the body part 73B has been printed reaches the position of the cutting part 17. Here, if the printing device 1 simply conveyed, without printing the specific header part described above, the tape 50 until the upstream end requiring cutting reached the position of the cutting part 17, a margin area would be created between the thermal head 10 and the cutting part 17. In the present embodiment, in order to prevent such a margin area from being created between the thermal head 10 and the cutting part 17 after a Job is completed, the printing device 1 performs the second printing operation to thereby print the specific header part on a portion of the tape 50 which passes through the thermal head 10 during a period of time from the time when the last object in the job has been printed to the time when the upstream end of the portion in which the last object in the job has been printed reaches the position of the cutting part 17. Therefore, in the present embodiment, a portion of the tape 50 in which a margin area would be created if the second printing operation was not performed can be effectively utilized.

Note that the printing device 1 can also be set to perform a half cut using the cutting part 17 at the border area between the header part 7A and body part 7B of the object 7. When this setting is made, the printing device 1 performs the following operations.

The printing device 1 prints the header part 71A of the object 71 on the tape 50 and subsequently begins printing the body part 71B of the object 71. In the middle of printing the body part 71B, the upstream end of the portion of the tape 50 in which the header part 71A of the object 71 has been printed and the downstream end of the portion of the tape 50 in which the body part 71B of the object 71 has been printed (hereinafter called a border area 81A between the header part 71A and body part 71B) become aligned with the position of the cutting part 17. At this time, the printing device 1 halts conveyance of the tape 50 and controls the cutting part 17 to perform a half cut at the border area 81A of the tape 50.

Figure 5D:
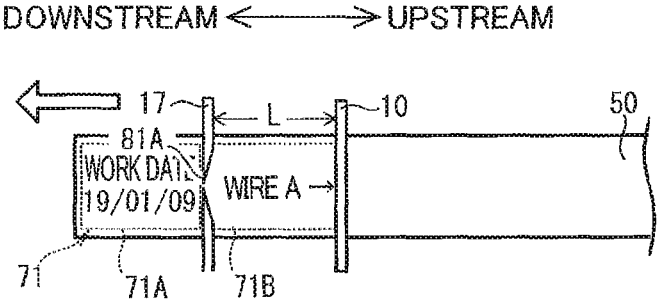
FIG. 5D is a view for describing a second example of the label creating method in the printing device 1 according to the embodiment, and illustrates a state in which a border area 81A between the header part 71A and the body part 71B is aligned with the cutting part 17 in the middle of printing the body part 71B.
Figure 5E:
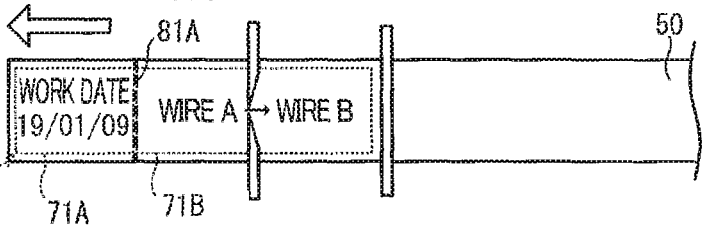
FIG. 5E is a view for describing the second example of the label creating method in the printing device 1 according to the embodiment, and illustrates a state in which printing of the body part 71B is completed.
Figure 5F:
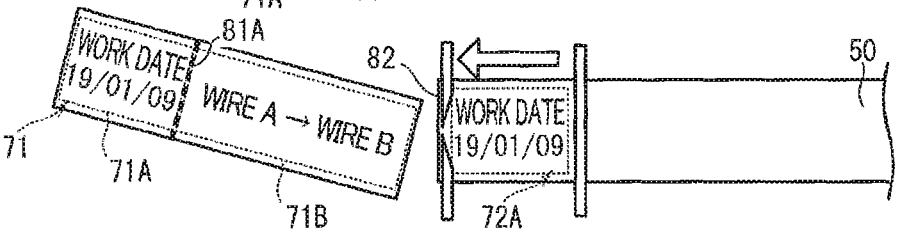
FIG. 5F is a view for describing the second example of the label creating method in the printing device 1 according to the embodiment, and illustrates a state in which cutting of the border area 82 is completed.

Subsequently, the printing device 1 resumes conveyance of the tape 50 and continues to print the remaining portion of the body part 71B on the tape 50, as illustrated in FIG. 5E. After completing printing of the body part 71B, the printing device 1 further prints the header part 72A of the next object 72 on the tape 50, as illustrated in FIG. 5F.

At the timing that printing of the header part 72A is completed, the border area 82 between the body part 71B and header part 72A is aligned with the position of the cutting part 17. Accordingly, the printing device 1 halts conveyance of the tape 50 and controls the cutting part 17 to perform a full cut at the border area 82 of the tape 50. Through this operation, the portion of the tape 50 in which the object 71 has been printed is cut off from the tape cassette 30. The above operations create the label 5B having a half cut formed at the border area 81A between the header part 71A and body part 71B.

Figures 6A, 6B, 6C, 6D:
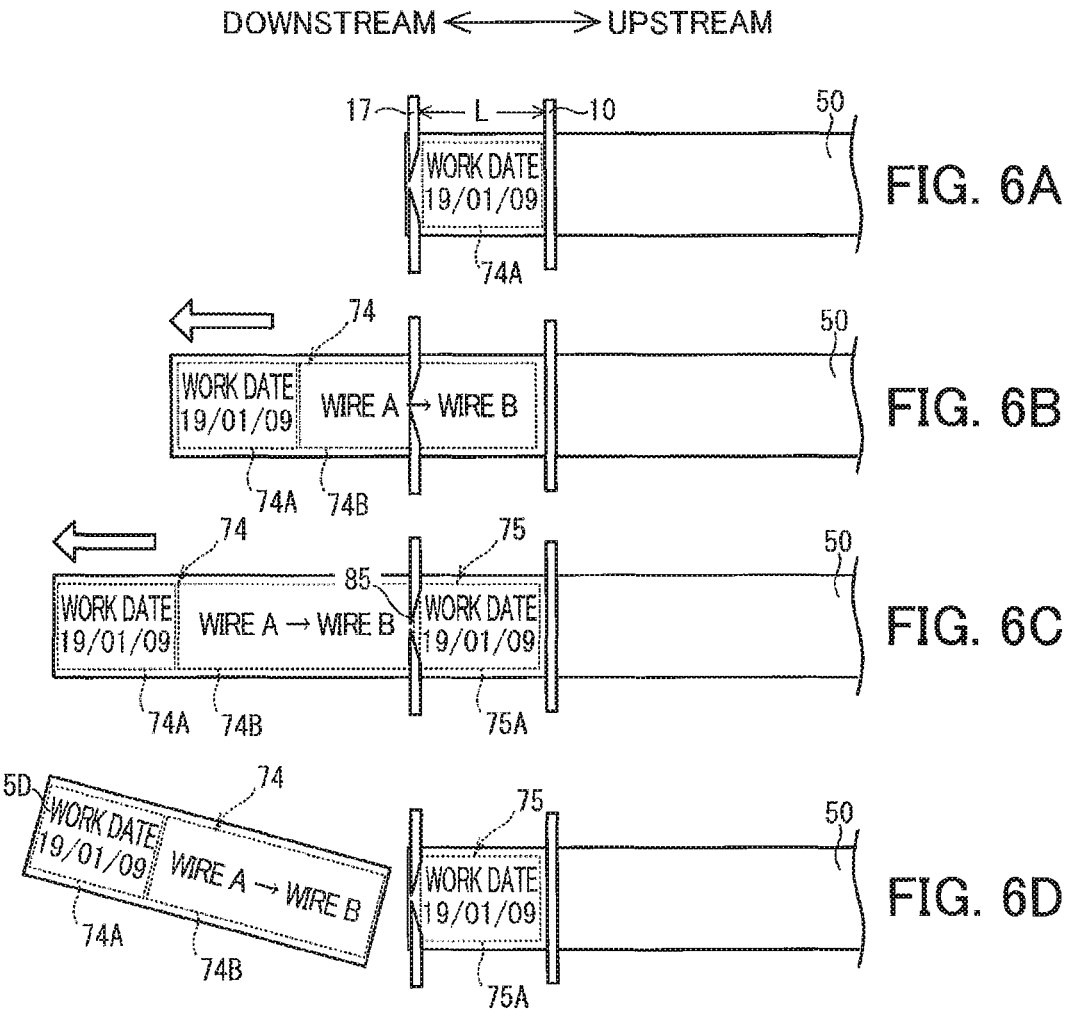
FIG. 6A is a view for describing a third example of the label creating method in the printing device 1 according to the embodiment, and illustrates a state in which the header part 74A (i.e., the specific header part) is positioned between the thermal head 10 and the cutting part 17 at the start time of a job.
FIG. 6B is a view for describing the third example of the label creating method in the printing device 1 according to the embodiment, and illustrates a state in which printing of a body part 74B is completed.
FIG. 6C is a view for describing the third example of the label creating method in the printing device 1 according to the embodiment, and illustrates a state in which printing of a header part 75A is completed and a border area 85 between the body part 74B and the header part 75A is aligned with the cutting part 17.
FIG. 6D is a view for describing the third example of the label creating method in the printing device 1 according to the embodiment, and illustrates a state in which cutting of the border area 85 is completed.
Figures 7A, 7B, 7C, 7D, 7E, 7F:
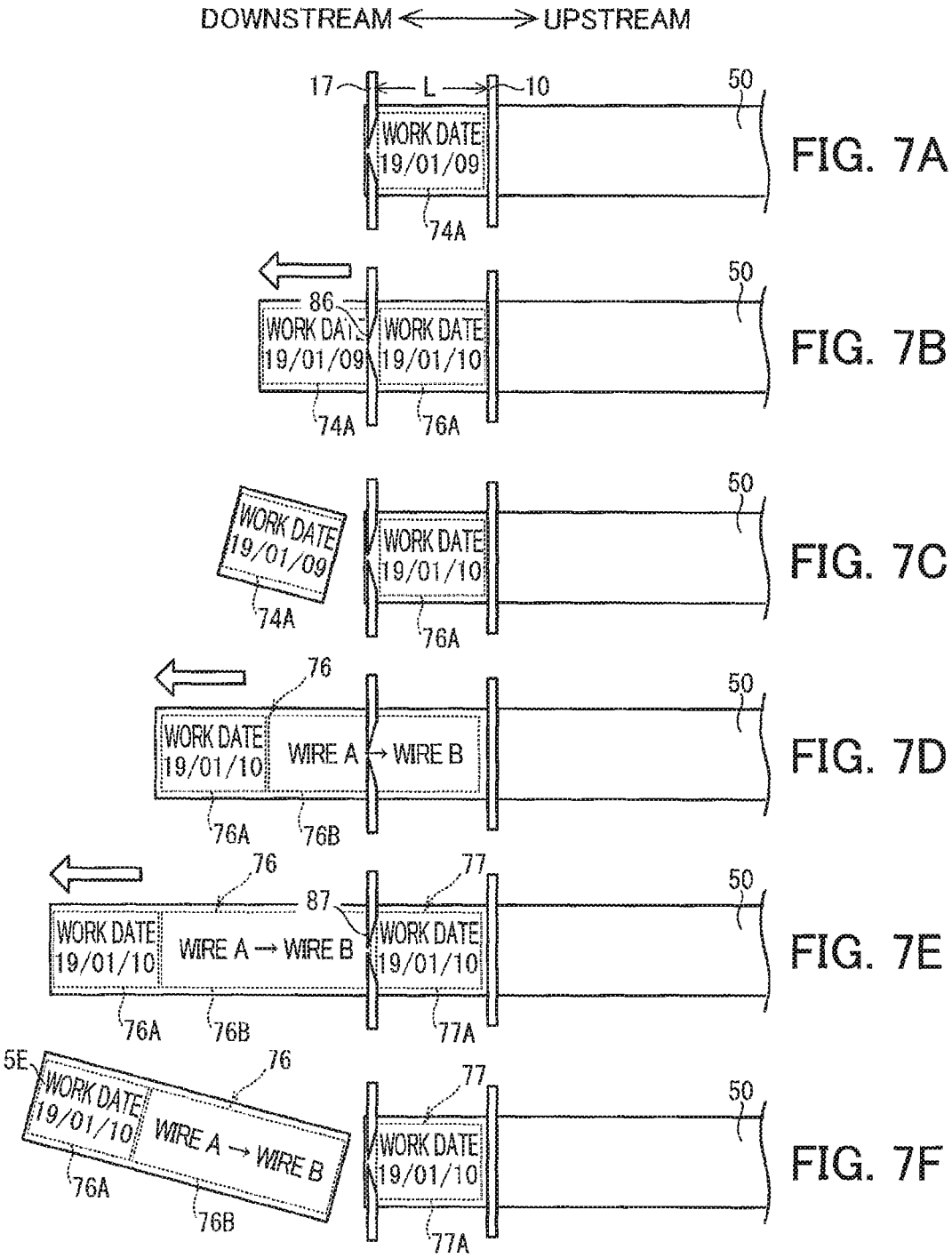
FIG. 7A is a view for describing a fourth example of the label creating method in the printing device 1 according to the embodiment, and illustrates a state in which the header part 74A (i.e., the specific header part) is positioned between the thermal head 10 and the cutting part 17 at the start time of a job.
FIG. 7B is a view for describing the fourth example of the label creating method in the printing device 1 according to the embodiment, and illustrates a state in which printing of a header part 76A is completed and a border area 86 between the header part 74A (i.e., the specific header part) and the header part 76A is aligned with the cutting part 17.
FIG. 7C is a view for describing the fourth example of the label creating method in the printing device 1 according to the embodiment, and illustrates a state in which cutting of the border area 86 is completed.
FIG. 7D is a view for describing the fourth example of the label creating method in the printing device 1 according to the embodiment, and illustrates a state in which printing of a body part 76B is completed.
FIG. 7E is a view for describing the fourth example of the label creating method in the printing device 1 according to the embodiment, and illustrates a state in which printing of a header part 77A is completed and a border area 87 between the body part 76B and the header part 77A is aligned with the cutting part 17.
FIG. 7F is a view for describing the fourth example of the label creating method in the printing device 1 according to the embodiment, and illustrates a state cutting of the border area 87 is completed.

After executing Job(1) as described above, the printing device 1 begins Job(2) when the next print command is inputted via the keyboard 3 (see FIG. 1). At the moment Job(2) is started, the portion in which the header part 74A (i.e., the specific header part printed in Job(1)) has been printed (see FIG. 5C) is positioned between the thermal head 10 and the cutting part 17, as illustrated in FIGS. 6A and 7A. In this case, as will be described below, the printing device 1 executes Job(2) differently than when initiating Job(1).

First, a case in which the header part 7A of the object 7 to be printed in Job(2) matches the header part 7A of the object 7 already printed in Job(1), i.e., a case in which the header part 7A of the object 7 to be printed in Job(2) matches the specific header part already printed in Job(1) will be described with reference to FIGS. 6A through 6D.

As illustrated in FIG. 6B, the printing device 1 heats the thermal head 10 and prints a body part 74B of an object 74 on the tape 50 while conveying the tape 50 downstream in the conveying direction. More specifically, the body part 74B is printed on a portion upstream of the portion in which the header part 74A (i.e., the specific header part) is already printed at the start time of Job(2). Note that the operation for cutting off the margin area 5A from the tape cassette 30 (see FIG. 4C) is unnecessary since the margin area 5A (see FIG. 4A) is not present in the tape 50 unlike in the case of Job(1). The object 74 is an example of the claimed "second object" The header part 7A of the object 74 is an example of the claimed "second header part." The print date "19/01/09" included in the header part 7A of the object 74 is an example of the claimed "second print date." The body part 74B is an example of the claimed "second body part." The portion in which the body part 74B has been printed is an example of the claimed "third portion."

After completing printing of the body part 74B, the printing device 1 heats the thermal head 10 and prints a header part 75A of the next object 75 on the tape 50 while continuing to convey the tape 50 downstream, as illustrated in FIG. 6C. More specifically, the header part 75A is printed on a portion upstream of the portion in which the body part 74B has been printed. That is, the header part 75A is printed on a portion upstream of the portion in which the object 74 has been printed.

At the timing that printing of the header part 75A is completed, the upstream end of the portion of the tape 50 in which the body part 74B of the object 74 has been printed and the downstream end of the portion of the tape 50 in which the header part 75A of the object 75 has been printed (hereinafter called a border area 85 between the body part 74B and header part 75A) are aligned with the position of the cutting part 17. Here, the printing device 1 halts conveyance of the tape 50 and controls the cutting part 17 to perform a full cut at the border area 85 of the tape 50. Through this action, the portion of the tape 50 in which the object 74 has been printed is cut off from the tape cassette 30, as illustrated in FIG. 6D. These operations create a label 5D in which the object 74 is printed. The printing device 1 repeats the printing operation for the object 7 as described above the specified number of times.

Next, a case in which the header part 7A of the object 7 to be printed in Job(2) differs from the header part 7A of the object 7 already printed in Job(1), i.e., a case in which the header part 7A of the object 7 to be printed in Job(2) differs from the specific header part already printed in Job(1) will be described with reference to FIGS. 7A through 7F. In FIGS. 7A through 7F, the print date included in the header part 7A has changed from "Work Date: 19/01/09" to "Work Date: 19/01/10." For example, this type of case occurs when the date changes between the execution of Job(1) and the execution of Job(2).

In this example, the header part 74A (i.e., the specific header part in Job(1)) already printed at the start time of Job(2) is not needed for Job(2) in which an object 76 having a header part 76A that does not match the already-printed specific header part (i.e., the header part 74A) is to be printed. Therefore, the printing device 1 prints the header part 76A of the object 76 on the tape 50 while conveying the tape 50 downstream, as illustrated FIG. 7B. More specifically, the header part 76A is printed on a portion upstream of the portion in which the header part 74A (the specific header part in Job(1)) is already printed at the start time of Job(2). The object 76 is an example of the claimed "second object." The header part 76A is an example of the claimed "second header part." The print date "19/01/10" included in the header part 76A is an example of the claimed "second print date." The portion in which the header part 76A has been printed is an example of the claimed "third portion."

At the timing that printing of the header part 76A is completed, the tape 50 has been conveyed downstream the distance L. At this time, the upstream end of the portion of the tape 50 in which the header part 74A has been printed and the downstream end of the portion of the tape 50 in which the header part 76A has been printed (hereinafter called a border area 86 between the header part 74A and header part 76A) are aligned with the position of the cutting part 17. Accordingly, the printing device 1 halts conveyance of the tape 50 and controls the cutting part 17 to perform a full cut at the border area 86 of the tape 50. These operations cut off the portion of the tape 50 in which the header part 74A (i.e., the specific header part in Job(1)) has been printed from the tape cassette 30, as illustrated in FIG. 7C.

Next, the printing device 1 resumes conveying the tape 50 downstream and heats the thermal head 10. Through this action, the printing device 1 prints a body part 76B of the object 76 on the tape 50, as illustrated in FIG. 7D. More specifically, the body part 76B is printed on the portion upstream of the portion in which the header part 76A has been printed. The body part 76B is an example of the claimed "second body part."

After printing of the body part 76B is completed, the printing device 1 heats the thermal head 10 and prints a header part 77A of the next object 77 on the tape 50 while continuing to convey the tape 50 downstream, as illustrated in FIG. 7E. More specifically, the header part 77A is printed on a portion upstream of the portion in which the body part 76B has been printed. That is, the header part 77A is printed on a portion upstream of the portion in which the object 76 has been printed.

At the timing that printing of the header part 77A is completed, the upstream end of the portion of the tape 50 in which the body part 76B of the object 76 has been printed and the downstream end of the portion of the tape 50 in which the header part 77A of the object 77 has been printed (hereinafter called a border area 87 between the body part 76B and header part 77A) are aligned with the position of the cutting part 17. At this time, the printing device 1 halts conveyance of the tape 50 and controls the cutting part 17 to perform a full cut at the border area 87 of the tape 50. This action separates the portion of the tape 50 in which the object 76 has been printed from the tape cassette 30, as illustrated in FIG. 7F. The above operations create a label SE on which the object 76 has been printed. The printing device 1 repeats the printing operation for the object 7 as described above the specified number of times.

<Setup Process>

Figure 8:
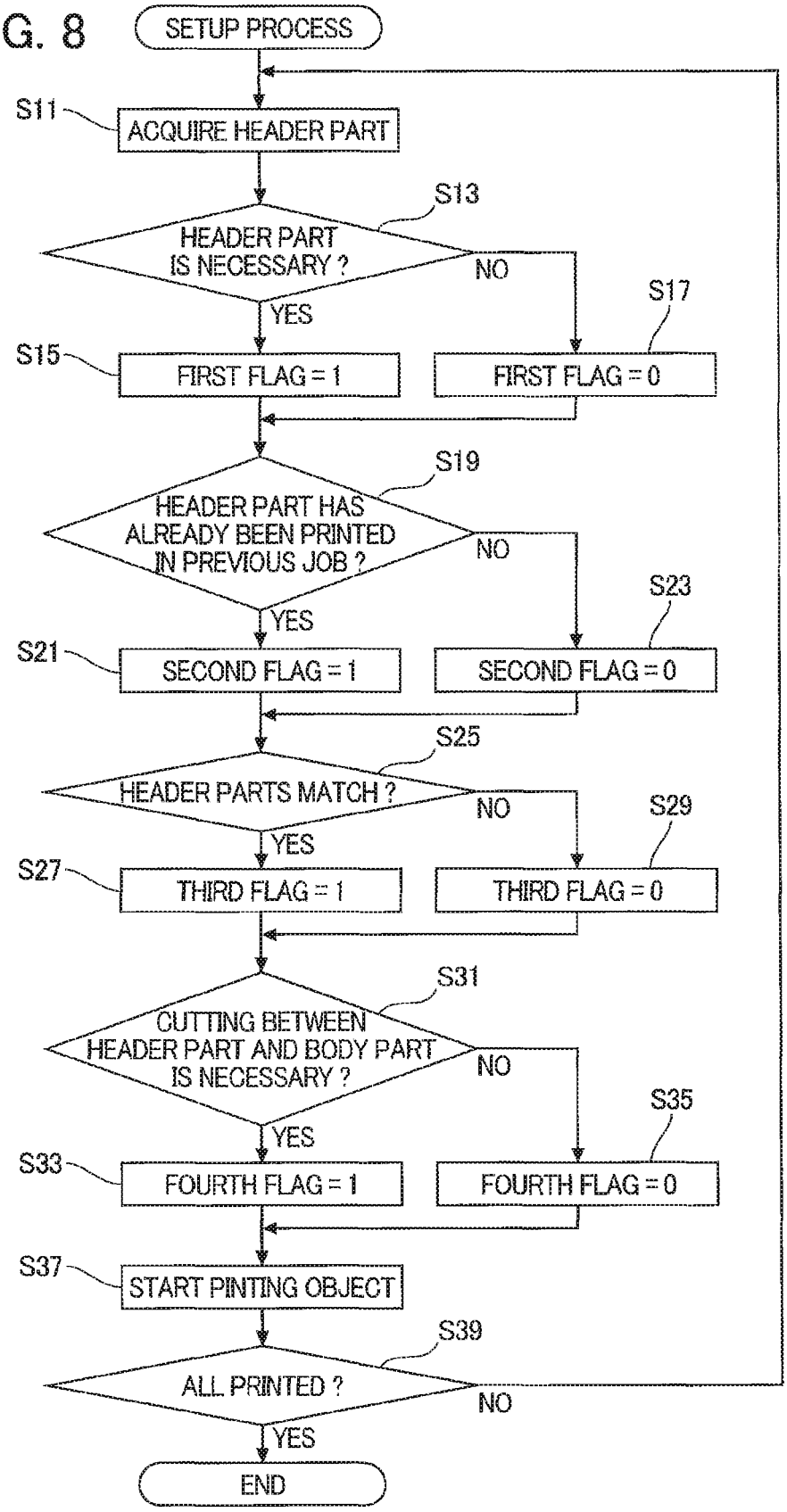
FIG. 8 is a flowchart of a setup process executed in the printing device 1 according to the embodiment.

Next, a setup process executed by the CPU 91 of the printing device 1 will be described with reference to FIG. 8. The setup process is executed to configure setup information required for printing an object. While executing a job, the CPU 91 begins the setup process at each timing just prior to printing each object 7. Accordingly, the setup process is executed for each object 7 to be printed in the job. For an object 7 to be printed immediately after the job is started, the setup process for configuring setup information for the object 7 is executed immediately after starting the job and just prior to printing the object 7, for example. For objects 7 to be printed second or later in the job, the setup process for configuring setup information for each object 7 is executed before printing of the immediately preceding object 7 is completed. The CPU 91 performs the setup process by reading a program stored in the flash memory 95 and executing the program.

A first object and a second object to be printed following the first object will be defined next. The second object is the target for which setup information is configured by the setup process. In other words, the second object is the object that is printed after the setup process is completed. The first object is the object printed just prior to the second object. In a case where the second object is an object 7 to be printed immediately after starting a job, an object 7 printed last in the immediately preceding job corresponds to the first object. The header part of the first object will be called the "first header part," the body part of the first object the "first body part," and the specific header part of the first object the "first specific header part." Similarly, the header part of the second object will be called the "second header part," the body part of the second object the "second body part," and the specific header part of the second object the "second specific header part."

In S11 at the beginning of the setup process in FIG. 8, the CPU 91 acquires information to be printed as the second header part of the second object (hereinafter called "second header part information"). In other words, in S11 the CPU 91 acquires the second header part of the second object.

More specifically, in the present embodiment, in S11 the CPU 91 acquires the second header part information by reading the first text information from the text memory included in the RAM 94. Note that the CPU 91 may acquire the date at the point of the input of the print command from a timer provided in the printing device 1 for identifying the current date, and use the acquired date as the date included in the second header part (e.g., "19/01/09" included in "WORK DATE: 19/01/09").

In S11 the CPU 91 further acquires information to be printed as the second body part of the second object (hereinafter called "second body part information"). In other words, the CPU 91 acquires the second body part of the second object. The CPU 91 acquires the second body part information by reading the second text information from the text memory included in the RAM 94. In this way, in S11 the CPU 91 acquires the second object (i.e., the second header part and the second body part of the second object). Note that, similarly to the above, the CPU 91 acquires the first object (i.e., the first header part and the first body part of the first object) in the setup process executed for the first object.

Furthermore, in S11 the CPU 91 stores the acquired second header part information in the flash memory 95. Note that second header part information is not acquired in S11 when the second object is formed only of the second body part, i.e., when the second object does not include a second header part.

In S13 the CPU 91 determines whether a second header part is necessary for the second object. When second header part information has been acquired in S11, the CPU 91 determines that the second header part is necessary (S13: YES). In S15 the CPU 91 sets a first flag to 1, and advances to S19. However, when second header part information has not been acquired in S11, the CPU 91 determines that the second header part is unnecessary (S13: NO). In this case, in S17 the CPU 91 sets the first flag to 0, and advances to S19.

In S19 the CPU 91 determines whether the first header part of the first object has already been printed, i.e., whether the first specific header part has already been printed. For example, when the second object is to be printed immediately after starting the job and the first specific header part is printed at the end of the previous job, as in the examples of FIGS. 6A, and 7A, the CPU 91 determines that the first header part of the first object has already been printed, i.e., that the first specific header part has already been printed (S19: YES). Also when the second object is to be printed immediately after starting the job and a margin area 5A has been formed between the thermal head 10 and the cutting part 17, as in the example of FIG. 4A, the CPU 91 determines that the first header part of the first object has already been printed, i.e., that the first specific header part has already been printed (S19: YES). In other words, when the second object is the object to be printed just after starting the job, the CPU 91 determines that the first header part of the first object has already been printed, i.e., that the first specific header part has already been printed (S19: YES). In this case, in S21 the CPU 91 sets a second flag to 1, and advances to S25.

However, when the second object is an object to be printed second or later in the job, as in the examples of FIGS. 4D, 5A, 6B, and 7D, the CPU 91 determines that the first header part of the first object has not been printed, i.e., that the first specific header part has not been printed (S19: NO). In this case, in S23 the CPU 91 sets the second flag to 0, and advances to S25.

When the CPU 91 determines in S19 that the first header part has already been printed, i.e., that the first specific header part has already been printed, the CPU 91 acquires the information printed as the first header part (hereinafter called the "first header part information"). More specifically, the CPU 91 acquires the first header part information by referencing the flash memory since the first header part information is already stored in the flash memory 95 in S11 of the previous job. Note that when the margin area 5A is formed as in the example of FIG. 4A, the first header part information acquired at this time represents a margin.

In S25 the CPU 91 determines whether the acquired first header part information matches the second header part information acquired in S11. Differently stated, in S25 the CPU 91 determines whether the first header part matches the second header part acquired in S11. Further, in other words, in S25 the CPU 91 determines whether the first specific header part matches the second header part acquired in S11. More specifically, the CPU 91 determines whether the print dates included in the first header part and second header part match. For example, when the CPU 91 determines that the first header part information and second header part information are both "Work Date: 19/01/09" as in the example of FIG. 6A and match each other (S25: YES), in S27 the CPU 91 sets a third flag to 1, and advances to S31.

On the other hand, when the CPU 91 determines that the first header part information differs from the second header part information, as in the examples of FIGS. 4A and 7A (S25: NO), in S29 the CPU 91 sets the third flag to 0, and advances to S31. Also when the second object is an object to be printed second or later in the job as in the examples of FIGS. 4D, 5A, 6B, and 7D and thus the CPU 91 has determined that the first header part of the first object has not been printed (S19: NO), the CPU 91 determines in S25 that the first header part information differs from the second header part information (S25: NO). In this case, in S29 the CPU 91 sets the third flag to 0, and advances to S31.

In S31 the CPU 91 determines whether a half cut is to be performed using the cutting part 17 at the border area between the second header part and the second body part. For example, when a setting operation for performing a half cut (as in the example of FIGS. 5D through 5F) at the border area 81A between the header part 71A and body part 71B is previously inputted through the keyboard 3, the CPU 91 determines that a half cut is to be performed at the border area between the second header part and the second body part (S31: YES). In this case, in S33 the CPU 91 sets a fourth flag to 1, and advances to S37.

However, when a setting operation for a half cut has not been inputted, the CPU 91 determines that a half cut is not to be performed at the border area between the second header part and the second body part (S31: NO), and advances to S35. In S35 the CPU 91 sets the fourth flag to 0, and advances to S37.

In S37 the CPU 91 starts a printing process described later (see FIG. 9) to begin printing the second object. In S39 the CPU 91 determines whether printing of all objects in the job has been completed. When even one unprinted object remains in the job (S39: NO), the CPU 91 returns to S11 and repeats the process in S11-S37 to configure setup information for printing the next object. The setup process is completed when the CPU 91 determines that printing of all objects in the job has been completed (S39: YES).

<Printing Process>

Next, the printing process executed by the CPU 91 of the printing device 1 will be described with reference to FIGS. 9 and 10. When executing the process of S37 in the setup process of FIG. 8, the CPU 91 initiates a printing process by reading a program stored in the flash memory 95 and executing the program. FIG. 10 illustrates a table 95A. The table 95A stores print settings 951 associated with different values for the first through fourth flags. Accordingly, when executing steps in the printing process, the CPU 91 determines operating conditions from the print settings 951 based on the first through fourth flags that have been set in the setup process. The print settings 951 specify whether printing of the header part is necessary. The value "1" stored in the print settings 951 indicates that printing of the header part is necessary, while the value "0" indicates that printing of the header part is unnecessary.

Figure 9:
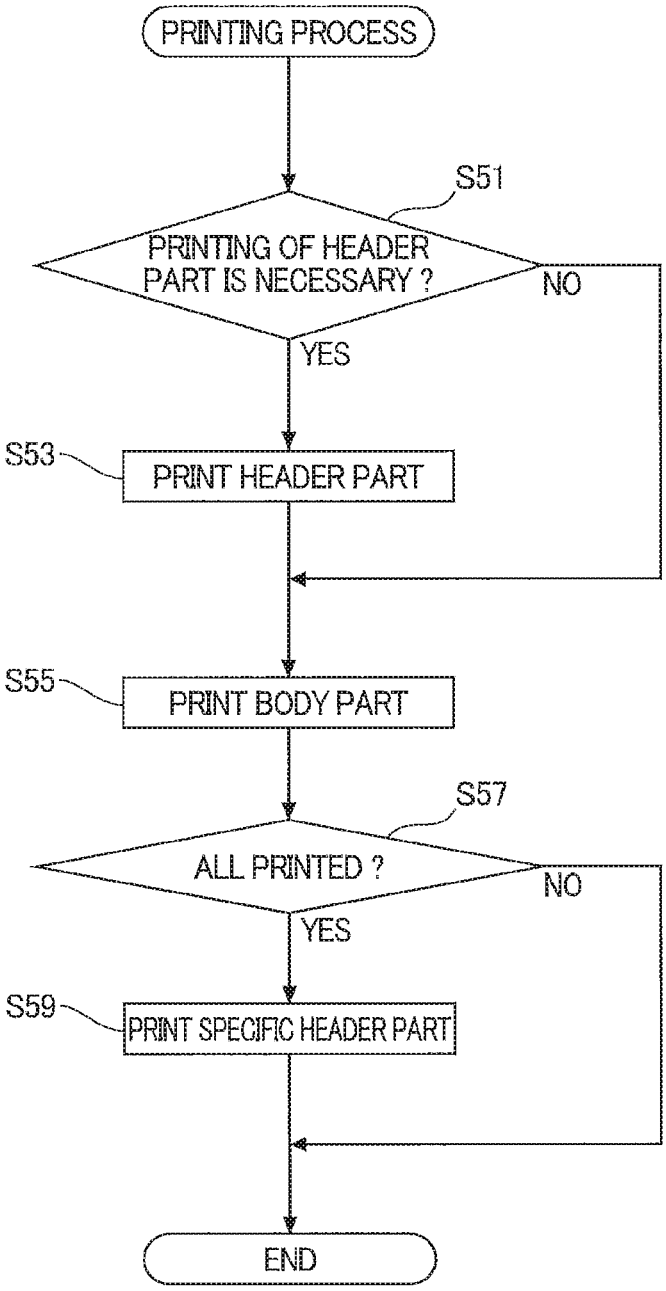
FIG. 9 is a flowchart of a printing process executed in the printing device 1 according to the embodiment.

In S51 at the beginning of the process in FIG. 9, the CPU 91 extracts, from the print settings 951 in the table 95A, information corresponding to the first through fourth flags set in the setup process and determines whether it is necessary to print the header part.

When the information extracted in S51 is "1", the CPU 91 determines that printing of the header part is necessary (S51: YES), and advances to S53. In S53 the CPU 91 prints the second header part on the tape 50. Specifically, the CPU 91 drives the tape feed motor 23 to rotate the ribbon take-up shaft and tape drive shaft in association with each other to convey the tape 50 downstream. The CPU 91 also heats the thermal head 10 based on the second header part information acquired in S11 of the setup process (see FIG. 8). Subsequently, the CPU 91 advances to S55. However, when the information for the print settings 951 extracted from the table 95A is "0", the CPU 91 determines that printing of the header part is unnecessary (S51: NO). In this case, the CPU 91 simply advances to S55.

In S55 the CPU 91 prints the second body part on the tape 50. After printing the second body part, in S57 the CPU 91 determines whether printing of all objects in the job has been completed. When the CPU 91 determines that printing of all objects in the job has been completed (S57: YES), in S59 the CPU 91 prints the second specific header part on the tape 50 and subsequently ends the printing process. Note that, as described above, the specific header part printed in S59 is the same as the second header part. On the other hand, when the CPU 91 determines in S57 that even one unprinted object remains in the job (S57: NO), the CPU 91 simply ends the printing process.

In a printing process for printing the second object at the end of Job(1), for example, the flag settings made in the setup process (see FIG. 8) may be first flag: 1 (second header part required), second flag: 0 (first header part not printed), third flag: 0 (first and second header parts differ), and fourth flag: 0 (cutting between second header part and second body part not required). In this case, the CPU 91 extracts "1" from the table 95A as the corresponding information in the print settings 951, as indicated in FIG. 10 (see box W1).

In this case, the CPU 91 determines in S51 of FIG. 9 that printing of the second header part is necessary (S51: YES). Then, the CPU 91 prints the second header part (a header part 73A, for example) and the second body part (the body part 73B, for example) in S53 and S55, respectively (as in the example of FIG. 5A). After printing the second header part and the second body part, the CPU 91 determines that printing of all objects has been completed (S57: YES). Then, in S59 the CPU 91 conveys the tape 50 downstream until the upstream end (the border area 84, for example) of the portion of the tape 50 in which the second object (the object 73, for example) has been printed reaches the position of the cutting part 17 (see FIG. 5B, for example). Simultaneously, in S59 the CPU 91 prints the second specific header part (the header part 74A, for example) having the same information as the second header part (the header part 73A, for example) of the second object (the object 73, for example) on the tape 50.

As another example, a printing process executed when Job(2) in which the second object is first printed is executed after Job(1) is executed as described above will be described. In this example, the print date included in the header part printed at the end of Job(1) is the same as the print date in the header part scheduled to be printed at the beginning of Job(2) (see FIG. 6A). In this case, flags set according to the setup process of FIG. 8 are first flag: 1 (second header part required), second flag: 1 (first header part printed), third flag: 1 (first and second header parts match), and fourth flag: 0 (cutting between second header part and second body part not required). As shown in FIG. 10, the CPU 91 extracts "0" from the table 95A as the corresponding information in the print settings 951 (see box W2).

In this case, the CPU 91 determines in S51 of FIG. 9 that printing of the second header part is unnecessary (S51: NO). Accordingly, the CPU 91 skips step S53 and prints in S55 the second body part (the body part 74B of in this example) on the upstream side of the portion of the tape 50 in which the first specific header part (the header part 74A in this example) is already printed in the preceding printing process. Here, one or more unprinted objects remain in the job (S57: NO). Thus, the CPU 91 skips step S59 and ends the current printing process.

On the other hand, the print date included in the header part printed at the end of Job(1) may differ from the print date included in the header part scheduled to be printed at the beginning of Job(2) (see the example of FIG. 7A). In this case, the flag settings established in the setup process of FIG. 8 are first flag: 1 (second header part required), second flag: 1 (first header part printed), third flag: 0 (first and second header parts differ), and fourth flag: 0 (cutting between second header part and second body part not required). As shown in FIG. 10, the CPU 91 extracts "1" from the table 95A as the corresponding information in the print settings 951 (see box W3).

In this case, the CPU 91 determines in S51 of FIG. 9 that printing of the second header part is necessary (S51: YES). In S53 the CPU 91 prints the second header part (the header part 76A) of the second object (the object 76) upstream of the portion of the tape 50 in which the first specific header part (the header part 74A) is already printed in the preceding printing process, as illustrated in the example of FIGS. 7A and 7B. Then, in S55 the CPU 91 prints the second body part (the body part 76B) of the second object (the object 76) upstream of the portion of the tape 50 in which the second header part (the header part 76A) is already printed, as illustrated in the example of FIG. 7D. Here, one or more unprinted objects remain in this job (S57: NO). Accordingly, the CPU 91 skips step S59 and ends the current printing process.

<Cutting Process>

Next, a cutting process executed by the CPU 91 of the printing device 1 will be described with reference to FIGS. 10 and 11. When a job is started in response to a print command received via the keyboard 3, the CPU 91 starts the cutting process by reading a program stored in the flash memory 95 and executing the program. The table 95A in FIG. 10 also stores cut settings 952 identified based on the first through fourth flags set in the setup process. While executing steps in the cutting process, the CPU 91 determines operating conditions based on these cut settings 952.

The cut settings 952 indicate whether a cut using the cutting part 17 is necessary. The cut settings 952 have cut settings 96A specifying whether a cut is necessary between two header parts, cut settings 96B specifying whether a cut is necessary between the header part and body part, and cut settings 96C specifying whether a cut is necessary between two jobs. The value "1" stored in each of the cut settings 952 indicates that a cut is necessary, while the value "0" indicates that a cut is unnecessary.

Figure 11:
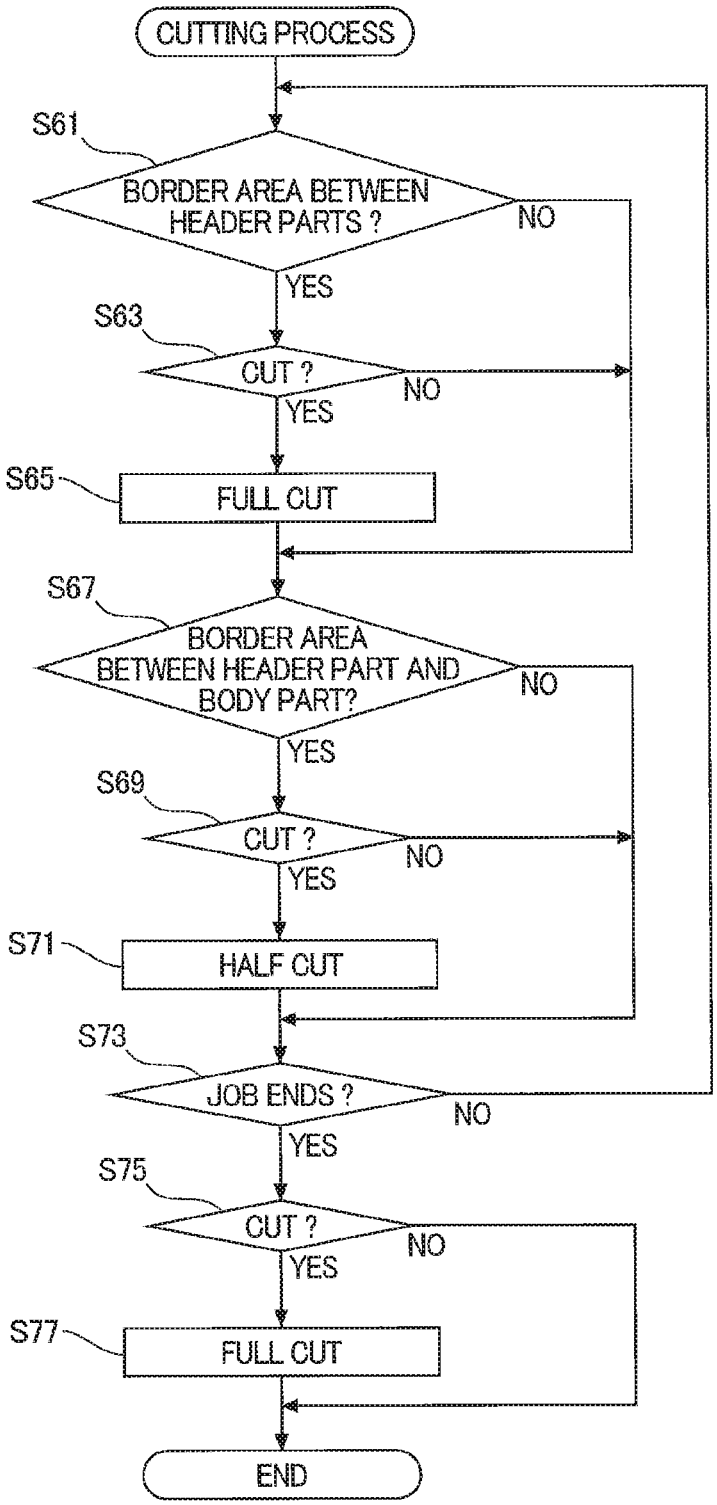
FIG. 11 is a flowchart of a cutting process executed in the printing device 1 according to the embodiment.

In S61 at the beginning of the cutting process in FIG. 11, the CPU 91 determines, in response to the tape 50 being conveyed during the printing process (see FIG. 9), whether the position of the border area between the two header parts is aligned with the position of the cutting part 17. When the CPU 91 determines that the position of the border area between the two header parts is not aligned with the position of the cutting part 17 (S61: NO), the CPU 91 advances to S67.

However, when the positional relationship of the tape 50 and the cutting part 17 is similar to that shown in FIG. 4B or 7B, the CPU 91 determines that the border area between the two header parts is aligned with the position of the cutting part 17 (S61: YES). In this case, in S63 the CPU 91 extracts, from the table 95A in FIG. 10, information for the cut setting 96A corresponding to the first through fourth flags set in the setup process, and determines whether cutting of the border area between the header parts is necessary.

When the extracted information is "0", the CPU 91 determines that cutting is unnecessary (S63: NO), and advances to S67. When the extracted information is "1", the CPU 91 determines that cutting is necessary (S63: YES), and advances to S65. At this time, the CPU 91 halts conveyance of the tape 50. In S65 the CPU 91 controls the cutting part 17 to perform a full cut at the portion on the tape 50 corresponding to the border area between the two header parts. Subsequently, the CPU 91 resumes conveying the tape 50 and advances to S67.

As one example, a case in which the cutting process is executed in a state shown in FIG. 7B will be described. In this case, the CPU 91 has determined in the setup process of FIG. 8 that the first specific header part (the header part 74A) differs from the second header part (the header part 76A) (S25: NO). Further, the flag values set in the setup process are first flag: 1 (second header part required), second flag: 1 (first header part printed), third flag: 0 (first and second header parts differ), and fourth flag: 0 (cutting between second header part and second body part not required). Accordingly, the CPU 91 extracts "1" from the table 95A as information for the corresponding cut setting 96A, as shown in FIG. 10 (see box W4). Therefore, in S65 the CPU 91 controls the cutting part 17 to perform a full cut at the border area 86 between the header part 74A and the header part 76A. In other words, in S65 the CPU 91 controls the cutting part 17 to perform a full cut at the upstream end of the portion of the tape 50 in which the first specific header part (the header part 74A) has been printed.

In S67 of FIG. 11, the CPU 91 determines, in response to the tape 50 being conveyed during the printing process (see FIG. 9), whether the position of the border area between the header part and the body part is aligned with the position of the cutting part 17. When the CPU 91 determines that the position of the border area between the header part and the body part is not aligned with the position of the cutting part 17 (S67: NO), the CPU 91 advances to S73.

However, when the tape 50 and cutting part 17 have a positional relationship similar to that shown in FIG. 5D, the CPU 91 determines that the position of the border area between the header part and the body part is aligned with the position of the cutting part 17 (S67: YES). In this case, in S69 the CPU 91 extracts, from the table 95A in FIG. 10, information for the cut setting 96B corresponding to the first through fourth flags set in the setup process, and determines whether a cut is necessary at the position of the border area between the header part and the body part.

When the extracted information is "0", the CPU 91 determines that a cut is unnecessary (S69: NO), and advances to S73. On the other hand, when the extracted information is "1", the CPU 91 determines that a cut is necessary (S69: YES), and advances to S71. At this time, the CPU 91 halts conveyance of the tape 50. In S71 the CPU 91 controls the cutting part 17 to perform a half cut at the position of the border area in the tape 50 between the header part and the body part. Subsequently, the CPU 91 resumes conveying the tape 50 and advances to S73.

As one example, a case in which the cutting process is executed in a state shown in FIG. 5D will be described. In this case, the flag values set in the setup process of FIG. 8 are first flag: 1 (second header part required), second flag: 0 (first header part not printed), third flag: 0 (first and second header parts differ), and fourth flag: 1 (cutting between second header part and second body part required). Thus, the CPU 91 extracts "1" from the table 95A as the information for the corresponding cut setting 96B, as shown in FIG. 10 (see box W5). Accordingly, in S71 the CPU 91 controls the cutting part 17 to perform a half cut at the border area 81A between the second header part (the header part 71A) and the second body part (the body part 71B).

In S73 of FIG. 11, the CPU 91 determines whether printing of all objects of the current job has been completed by the printing process of FIG. 9. When the CPU 91 determines that even one unprinted object remains in the job (S73: NO), the CPU 91 returns to S61. However, when the CPU 91 determines that printing of all objects in the job has been completed, as in the example of FIG. 5C (S73: YES), the CPU 91 advances to S75.

In S75 the CPU 91 extracts, from the table 95A of FIG. 10, information for the cut setting 96C corresponding to the first through fourth flags set in the setup process, and determines whether a cut is necessary at the position of the border area between the body part last printed in the current job and the specific header part printed after the last object in the current job. When the extracted information is "0", the CPU 91 determines that a cut is unnecessary (S75: NO) and ends the cutting process. Note that, in table 95A of FIG. 10, the value "1" is stored for all values of the cut setting 96C. Thus, since the extracted information is always "1", the CPU 91 determines that a cut is necessary (S75: YES). Hence, in S77 the CPU 91 controls the cutting part 17 to perform a full cut at the border area of the tape 50 between the last body part in the current job and the specific header part in the current job (for example, see FIG. 5C), and subsequently ends the cutting process.

Effects of the Embodiment

As shown in FIG. 7, when the header part 74A (i.e., the specific header part) already printed on the tape 50 differs from the header part 76A of the object 76 scheduled to be printed next (S25: NO), the CPU 91 of the printing device 1 cuts off, using the cutting part 17, the portion of the tape 50 in which the header part 74A (i.e., the specific header part) has been printed (FIG. 7C, S65). Further, the CPU 91 prints the header part 76A and body part 76B of the object 76 on the tape 50 (FIGS. 7B-7D, S53 and S57). In this case, the user does not need to perform an operation for cutting the portion of the tape 50 in which the unneeded header part 74A has been printed. Accordingly, even when the header part 74A already printed on the tape 50 differs from the header part 76A, the printing device 1 can print the object 76 on the tape 50 without requiring a user operation, while effectively using the tape 50 by printing the header part 76A on the margin area between the thermal head 10 and the cutting part 17.

In the above case, the CPU 91 of the printing device 1 performs a full cut using the cutting part 17 to cut off the portion of the tape 50 in which the header part 74A (i.e., the specific header part) has been printed. Hence, the printing device 1 can cut off the unneeded header part 74A on the tape 50 from the portion of the tape 50 in which the object 76 is printed.

As shown in FIGS. 5D through 5F, the CPU 91 of the printing device 1 can perform a half cut with the cutting part 17 at the border area 81A between the header part 71A and body part 71B (S71). Thus, when using a label on which the object 71 has been printed (i.e., the portion of the tape 50 on which the object 71 has been printed), the user can use the header part 71A and body part 71B in their separation state, or can use the header part 71A and body part 71B in their joined state. Accordingly, the printing device 1 can enhance the convenience of the label on which the object 71 is printed.

At least part of the header part includes the print date. As shown in FIGS. 7A through 7F, the CPU 91 of the printing device 1 determines whether the print dates included in the header parts 74A (i.e., the specific header part) and the header part 76A match each other (S25). As in the example of FIG. 7B, the date on which the header part 74A (i.e., the specific header part) is printed on the tape 50 may differ from the date on which the header part 76A is printed next on the tape 50. In such cases, the printing device 1 can cut off, without requiring a user operation, the portion of the tape 50 in which the header part 74A (i.e., the specific header part) has been printed, and print the object 76 on the tape 50.

Modification of the Embodiment

Next, a modification of the embodiment described above will be described while referring to FIGS. 12 through 16D, wherein like parts and steps are designated by the same reference numeral as those shown in the above-described embodiment for avoiding duplicating description.

The present modification is different from the above-described embodiment in that a printing mode for the printing operation of the printing device 1 according to the present modification can be switched between a first mode and a second mode. More specifically, users can select one of the first mode and the second mode by inputting, via the keyboard 3, a print command specifying the user's desired mode. Further, in order to selectively perform one of the first mode and the second mode, the CPU 91 of the printing device 1 according to the present modification executes a printing process shown in FIG. 12, instead of the printing process shown in FIG. 9. Note that the present modification is the same as the above-described embodiment, except for the above difference.

The first mode is a mode in which the same printing operation as that performed in the above-described embodiment is performed. Thus, detailed description of the first mode will be omitted.

The second mode is a mode in which the header part 7A for each object 7 printed second or later in a Job is not printed. Accordingly, as a result of performing the printing operation under the second mode, the object 7 printed first in a job has both the header part 7A and the body part 7B, while each object printed second or later in the job has only the body part 7B. Note that, also in the printing operation under the second mode, the specific header part is printed last in the job.

Next, the printing process of FIG. 12 executed by the CPU 91 of the printing device 1 according to the present modification will be described. When executing the process of S37 in the setup process of FIG. 8, the CPU 91 starts the printing process shown in FIG. 12 by reading a program stored in the flash memory 95 and executing the program.

Figure 12:
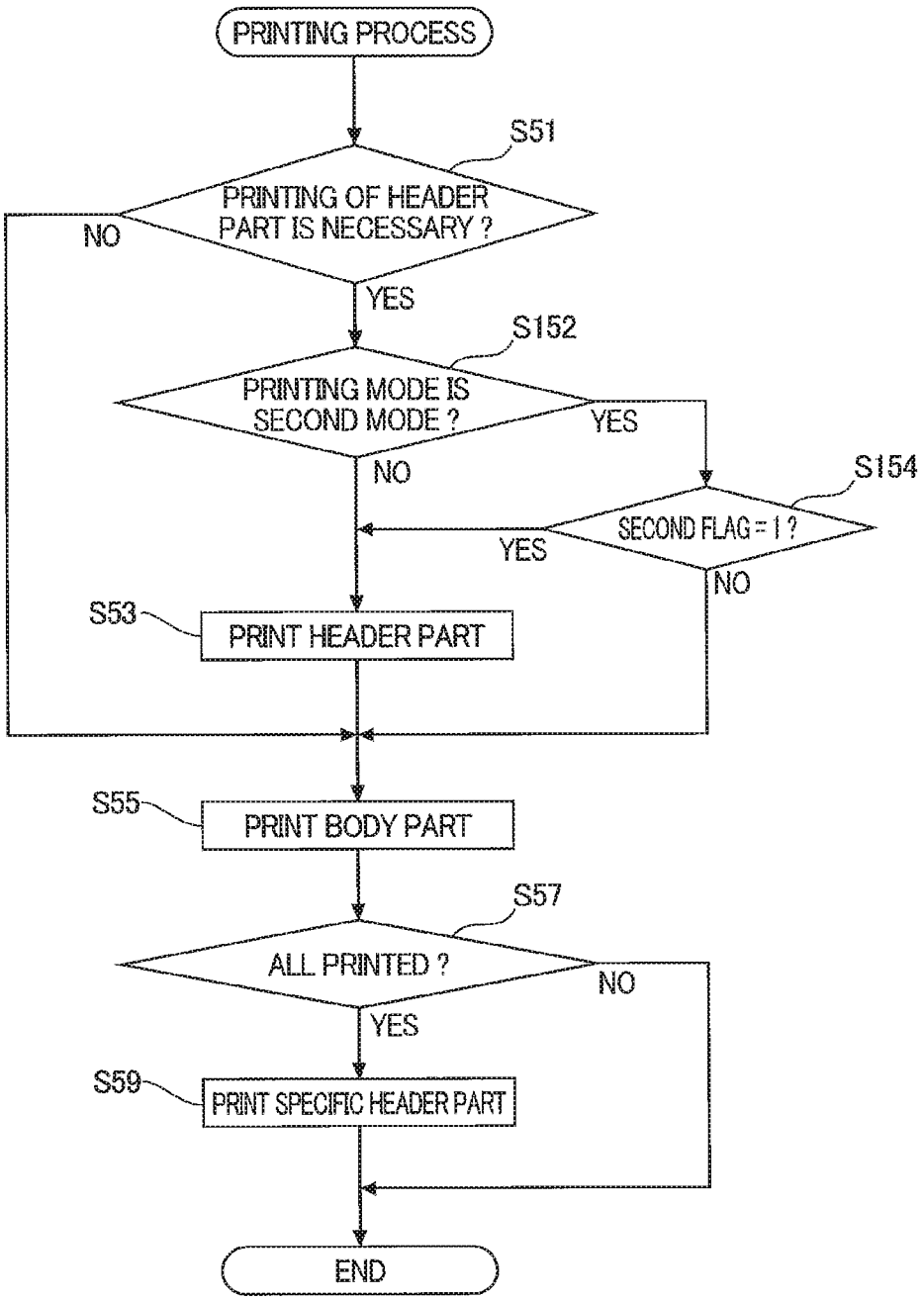
FIG. 12 is a flowchart of a printing process executed in a printing device 1 according to a modification of the embodiment.

In S51 at the beginning of the process in FIG. 12, the CPU 91 extracts, from the print settings 951 in the table 95A, information corresponding to the first through fourth flags set in the setup process and determines whether printing of the header part 7A is necessary.

When the information extracted in S51 is "0", the CPU 91 determines that printing of the header part 7A is unnecessary (S51: NO), skips steps S152, S154, S53, and advances to S55. In this case, in S55 the CPU 91 prints the body part 7B on the portion upstream of the portion in which the specific header part is already printed at the start time of the current job, and advances to S57.

However, when the information extracted in S51 is "1", the CPU 91 determines that printing of the header part 7A is necessary (S51: YES), and advances to S152. In S152 the CPU 91 determines whether the printing mode has been set to the second mode. The CPU 91 determines the printing mode has been set to the second mode when the print command inputted via the keyboard 3 indicates the second mode, while determines that the printing mode has not been set to the second mode when the inputted print command indicates the first mode.

When the CPU 91 determines in S152 that the printing mode has not been set to the second mode, i.e., that the printing mode has been set to the first mode (S152: NO), the CPU 91 advances to S53 and prints the header part 7A on the portion upstream of the portion in which the specific header part is already printed at the start time of the current job or on the portion upstream of the portion in which the body part 7B is printed by the preceding printing process in the current job. In this case, after printing the header part 7A in S53, in S55 the CPU 91 prints the body part 7B on the portion upstream of the portion in which the header part 7A is printed in S53, and then advances to S57.

On the other hand, when the CPU 91 determines in S152 that the printing mode has been set to the second mode (S152: YES), the CPU 91 advances to S154. In S154 the CPU 91 determines whether the second flag set in the setup process of FIG. 8 is "1", i.e., the second flag has been set to "1". In other words, in S154 the CPU 91 determines whether the object 7 to be printed in the current printing process is an object 7 to be printed first in the current job. Note that, in the setup process of FIG. 8, the second flag is set to "1" for an object 7 to be printed first in a job, while the second flag is set to "0" for each object 7 to be printed second or later in a job, as described above.

When the CPU 91 determines in S154 that the second flag has been set to "1", i.e., that the object 7 to be printed in the current printing process is an object 7 to be printed first in the current job, the CPU 91 advances to S53 and prints the header part 7A on the portion upstream of the portion in which the specific header part is already printed at the start time of the current job. In this case, after printing the header part 7A in S53, in S55 the CPU 91 prints the body part 7B on the portion upstream of the portion in which the header part 7A is printed in S53, and then advances to S57.

However, when the CPU 91 determines in S154 that the second flag has not been set to "1", i.e., that the object 7 to be printed in the current printing process is an object 7 to be printed second or later in the current job, the CPU 91 skips S53 and advances to S55 without printing the header part 7A. In this case, in S55 the CPU 91 prints the body part 7B on the portion upstream of the portion in which the body part 7B for the preceding object is printed by the preceding printing process in the current job, and then advances to S57. Note that description of processes performed in steps S57 and S59 shown in FIG. 12 will be omitted since these steps are the same as those shown in FIG. 9.

As described above, when the printing mode is set to the first mode in the present modification and printing of the header part 7A is determined to be necessary in S51, the CPU 91 always advances from S51 to S53 via S152 while skipping S154. This scenario is the same as a scenario in which the CPU 91 of the printing device 1 according to the above-described embodiment advances from S51 to S53 shown FIG. 9. That is, the printing operation performed in the present modification when the printing mode is set to the first mode is the same as the printing operation performed in the above-described embodiment.

Further, in the second mode of the present modification, when the object 7 to be printed by the current printing process is an object 7 to be printed second or later in the current job, the process of S53 for printing the header part 7A is skipped by the determination process of S154 Accordingly, as a result of performing the printing operation under the second mode, the object 7 printed first in a job has both the header part 7A and the body part 7B while each object printed second or later in the job has only the body part 7B.

Next, the printing operation performed in a state where the printing mode is set to the second mode will be described in detail with reference to FIGS. 13A through 16D. The following examples will presume that Job(2) is performed after Job(1) is completed and that the specified number of times inputted for Job(2) is 3 (i.e., three times).

First, a case in which the header part 7A of the object 7 to be printed in Job(2) matches the header part 7A of the object 7 already printed in Job(1), i.e., a case in which the header part 7A of the object 7 to be printed in Job(2) matches the specific header part printed at the end of Job(1) will be described with reference to FIGS. 13A through 14D. In FIGS. 13A through 14D, the print date "Work Date: 19/01/09" included in the header part 7A has not changed between Job(1) and Job(2). For example, this type of case occurs when Job(1) and Job(2) are executed on the same date.

Further, in this case, three objects 175, 176, and 177 and a header part 178A (i.e., a specific header part that is the same as the header parts of the objects 175, 176, and 177) are printed in this order since the specified number of times is 3 (three times) as described above. Furthermore, the flag values set in the setup process of FIG. 8 for the object 175 to be printed first in Job(2) are first flag: 1 (header part required), second flag: 1 (header part already printed in Job(1)), third flag: 1 (header parts match), and fourth flag: 0 (cutting between header part and body part required). Moreover, the flag values set for the objects 176 and 177 to be printed second or later in Job(2) are first flag: 1 (header part required), second flag: 0 (header part already printed in Job(1)), third flag: 1 (header parts match), and fourth flag: 0 (cutting between header part and body part required).

Figures 13A, 13B, 13C, 13D:
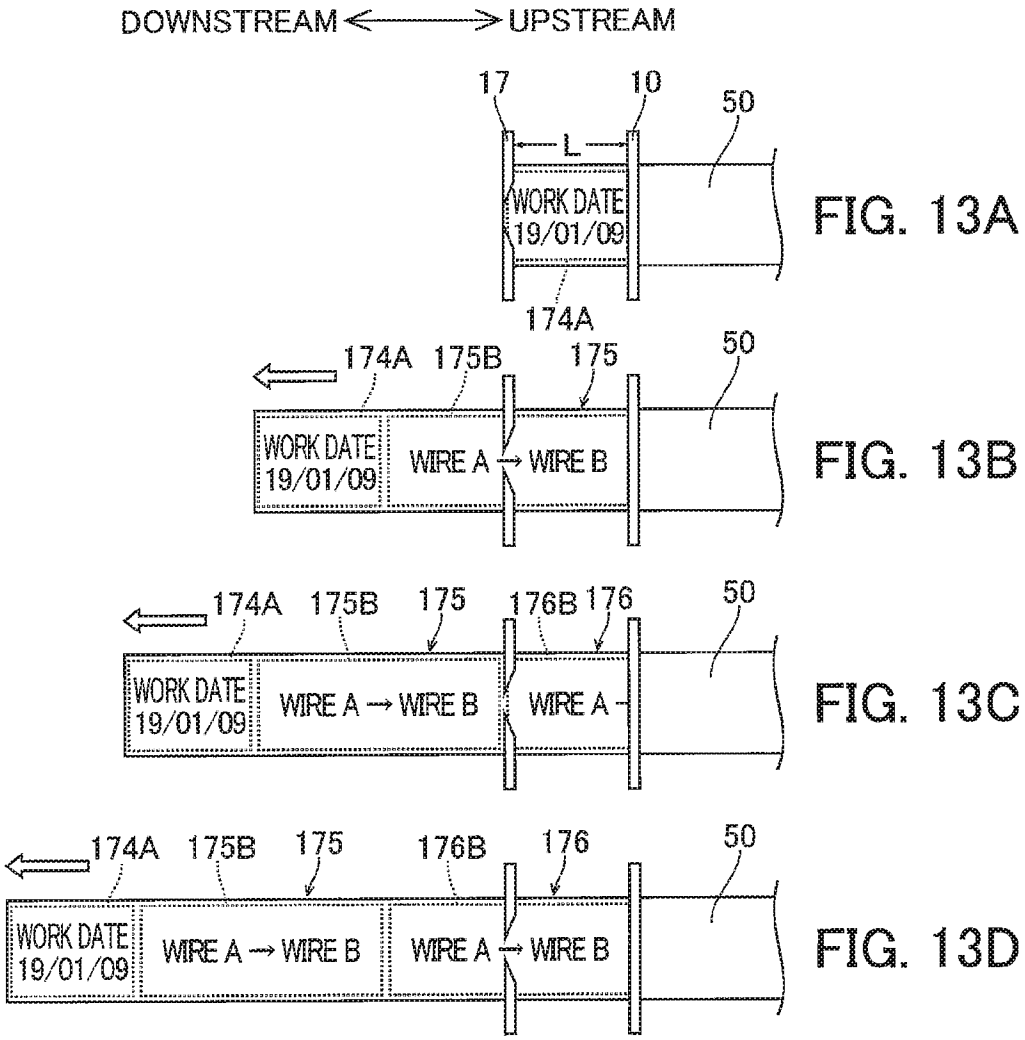
FIG. 13A is a view for describing a first example of a label creating method in the printing device 1 according to the modification, and illustrates a state in which a header part 174A (i.e., the specific header part) is positioned between the thermal head 10 and the cutting part 17 at the start time of a job.
FIG. 13B is a view for describing the first example of the label creating method in the printing device 1 according to the modification, and illustrates a state in which printing of a body part 175B is completed.
FIG. 13C is a view for describing the first example of the label creating method in the printing device 1 according to the modification, and illustrates a state in which a border area between the body part 175B and a body part 176B is aligned with the cutting part 17 in the middle of printing the body part 176B.
FIG. 13D is a view for describing the first example of the label creating method in the printing device 1 according to the modification, and illustrates a state in which printing of the body part 176B is completed.

As illustrated in FIG. 13A, at the beginning of Job(2), a header part 174A (i.e., a specific header part) printed at the end of Job(1) is present between the thermal head 10 and the cutting part 17. From this point, as shown in FIG. 13B, the printing device 1 heats the thermal head 10 and conveys the tape 50 downstream to print a body part 175B of the object 175 on the tape 50 without printing a header part 7A of the object 175 (S51: NO and S55 in FIG. 12). More specifically, the body part 175B is printed on the portion upstream of the portion in which the header part 174A (i.e., the specific header part) is already printed at the start time of Job(2). Note that, since the header part 174A (i.e., the specific header part) already printed at the start of Job(2) matches the header part 7A of the object 175 to be printed first in Job(2) in this example, the header part 7A of the object 175 is not printed and the header part 174A printed at the end of Job(1) is used as the header part 7A of the object 175. The object 175 is an example of the claimed "second object." The header part 7A of the object 175 is an example of the claimed "second header part." The print date "19/01/09" included in the header part 7A of the object 175 is an example of the claimed "second print date." The body part 175B is an example of the claimed "second body part." The portion in which the body part 175B has been printed is an example of the claimed "third portion."

After completing printing of the body part 175B, as shown in FIGS. 13C and 13D, the printing device 1 heats the thermal head 10 and continues to convey the tape 50 downstream to print a body part 176B of the next object 176 on the tape 50 without printing a header part 7A of the next object 176 (S51: YES, S152: YES, S154: NO and S55 in FIG. 12). More specifically, the body part 176B is printed on the portion upstream of the portion in which the body part 175B has been printed. That is, the body part 176B is printed on the portion upstream of the portion in which the object 175 has been printed. Note that, since the object 176 is to be printed second in Job(2), the header part 7A of the object 176 is not printed despite the fact that the CPU 91 determines in S51 of FIG. 12 that printing of the header part 7 is necessary. Further, although a border area between the body part 175B and the body part 176B is not cut in this example, a full cut or a half cut may be performed at the border area between the body part 175B and the body part 176B.

Figures 14A, 14B, 14C, 14D:
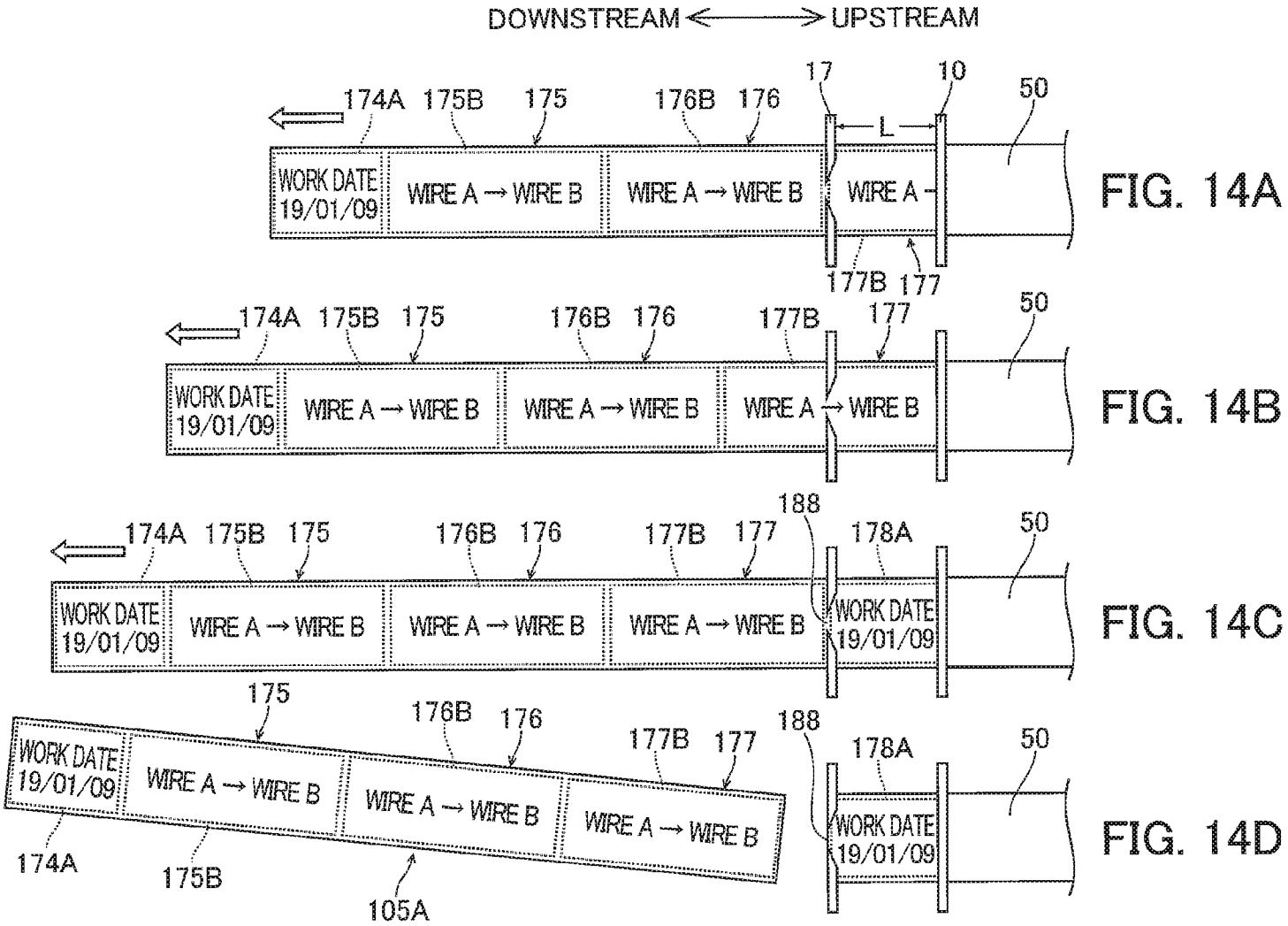
FIG. 14A is a view for describing the first example of the label creating method in the printing device 1 according to the modification, and illustrates a state in which a border area between the body part 176B and a body part 177B is aligned with the cutting part 17 in the middle of printing the body part 177B.
FIG. 14B is a view for describing the first example of the label creating method in the printing device 1 according to the modification, and illustrates a state in which printing of the body part 177B is completed.
FIG. 14C is a view for describing the first example of the label creating method in the printing device 1 according to the modification, and illustrates a state in which printing of a header part 178A (i.e., a specific header part) is completed and a border area 188 between the body part 177B and the header part 178A is aligned with the cutting part 17.
FIG. 14D is a view for describing the first example of the label creating method in the printing device 1 according to the modification, and illustrates a state in which cutting of the border area 188 is completed.

After completing printing of the body part 175B, as shown in FIGS. 14A and 14B, the printing device 1 heats the thermal head 10 and continues to convey the tape 50 downstream to print a body part 177B of the last object 177 on the tape 50 without printing a header part 7A of the last object 177 (S51: YES, S152: YES, S154: NO and S55 in FIG. 12). More specifically, the body part 177B is printed on the portion upstream of the portion in which the body part 176B has been printed. That is, the body part 177B is printed on the portion upstream of the portion in which the object 176 has been printed. Note that, since the object 177 is to be printed last in Job(2), the header part 7A of the last object 177 is not printed despite the fact that the CPU 91 determines in S51 of FIG. 12 that printing of the header part 7A is necessary. Further, although a border area between the body part 176B and the body part 177B is not cut in this example, a full cut or a half cut may be performed at the border area between the body part 176B and the body part 177B. The object 177 is an example of the claimed "first object." The header part 7A of the object 177 is an example of the claimed "first header part." The print date "19/01/09" included in the header part 7A of the object 177 is an example of the claimed "first print date." The body part 177B is an example of the claimed "first body part." The portion in which the body part 177B has been printed is an example of the claimed "first portion."

After completing printing of the body part 177B, as shown in FIG. 14C, the printing device 1 heats the thermal head 10 and continues to convey the tape 50 downstream to print a header part 178A (i.e., the specific header part for Job(2)) (S57: YES and S59 in FIG. 12). More specifically, the header part 178A is printed on the portion upstream of the portion in which the body part 177B has been printed. That is, the header part 178A, i.e., the specific header part for Job (2) is printed on the portion upstream of the portion in which the last object 177 has been printed. The header part 178A is an example of the claimed "specific header part." The portion in which the header part 178A has been printed is an example of the claimed "second portion."

At the timing that printing of the header part 178A is completed, the upstream end of the portion of the tape 50 in which the body part 177B of the object 177 has been printed and the downstream end of the portion of the tape 50 in which the header part 178A has been printed (hereinafter called a border area 188 between the body part 177B and header part 178A) are aligned with the position of the cutting part 17 as shown in FIG. 14C. Here, the printing device 1 halts conveyance of the tape 50 and controls the cutting part 17 to perform a full cut at the border area 188 of the tape 50, thereby ending Job(2). Through this action, the portion of the tape 50 in which the objects 175, 176, and 177 have been printed is cut off from the tape cassette 30, and the header part 178 (i.e., the specific header part for Job(2)) is left between the thermal head 10 and the cutting part 17, as illustrated in FIG. 14D. These operations create a label 105A in which the objects 175, 176, and 177 have been printed. Note that, although a full cut is performed at the border area 188 in this example, a half cut may be performed at the border area 188 instead of the full cut.

Next, a case in which the header part 7A of the object 7 to be printed in Job(2) differs from the header part 7A of the object 7 already printed in Job(1), i.e., a case in which the header part 7A of the object 7 to be printed in Job(2) differs from the specific header part printed at the end of Job(1) will be described with reference to FIGS. 15A through 16D. In FIGS. 15A through 16D, the print date included in the header part 7A has changed from "Work Date: 19/01/09" to "Work Date: 19/01/10." For example, this type of case occurs when the date changes between the execution of Job(1) and the execution of Job(2).

Further, in this case, three objects 275, 276, and 277 and a header part 278A (i.e., a specific header part that is the same as the header parts of the objects 275, 276, and 277) are printed in this order since the specified number of times is 3 (three times) as described above. Furthermore, the flag values set in the setup process of FIG. 8 for the object 275 to be printed first in Job(2) are first flag: 1 (header part required), second flag: 1 (header part already printed in Job(1)), third flag: 0 (header parts differ), and fourth flag: 0 (cutting between header part and body part required). Moreover, the flag values set for the objects 276 and 277 to be printed second or later in Job(2) are first flag: 1 (header part required), second flag: 0 (header part already printed in Job(1)), third flag: 0 (header parts differ), and fourth flag: 0 (cutting between header part and body part required).

Figures 15A, 15B, 15C, 15D:
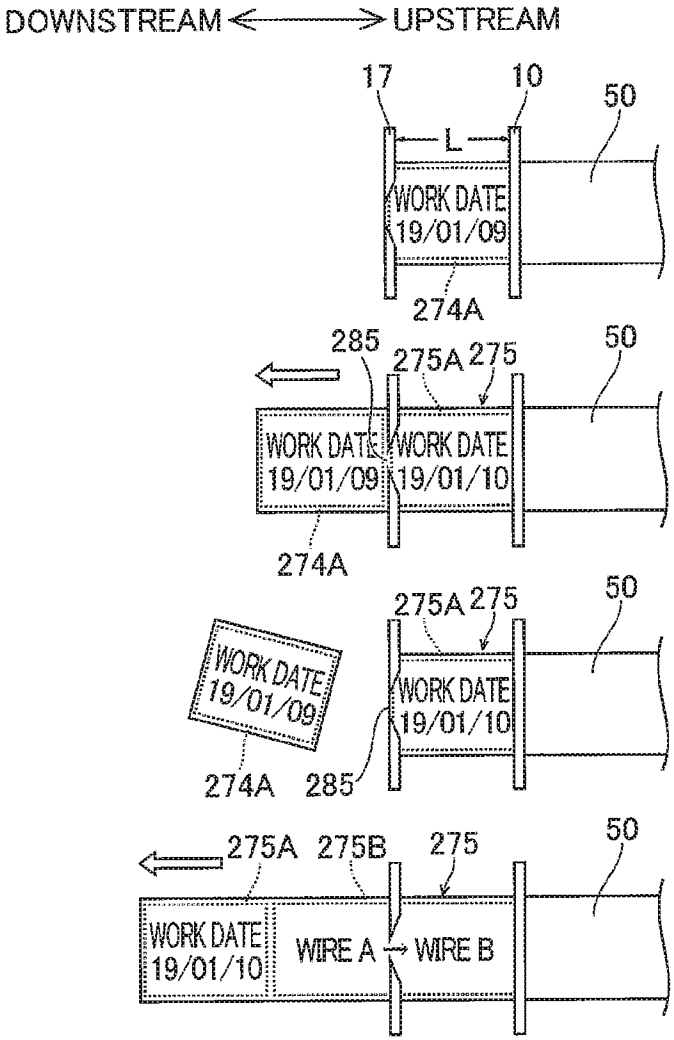
FIG. 15A is a view for describing a second example of the label creating method in the printing device 1 according to the modification, and illustrates a state in which a header part 274A (i.e., the specific header part) is positioned between the thermal head 10 and the cutting part 17 at the start time of a job.
FIG. 15B is a view for describing the second example of the label creating method in the printing device 1 according to the modification, and illustrates a state in which printing of a header part 275A is completed and a border area 285 between the header part 274A (i.e., the specific header part) and the header part 275A is aligned with the cutting part 17.
FIG. 15C is a view for describing the second example of the label creating method in the printing device 1 according to the modification, and illustrates a state in which cutting of the border area 285 is completed.
FIG. 15D is a view for describing the second example of the label creating method in the printing device 1 according to the modification, and illustrates a state in which printing of a body part 275B is completed.

As illustrated in FIG. 15A, at the beginning of Job(2), a header part 274A (i.e., the specific header part) printed at the end of Job(1) is present between the thermal head 10 and the cutting part 17. In this example, the header part 274A already printed at the start time of Job(2) (i.e., the specific header part printed at the end of Job(1)) is not needed for Job(2) in which the object 275 having a header part 275A that does not match the already-printed header part 274A (i.e., the specific header part) is to be printed. Therefore, the printing device 1 heats the thermal head 10 and prints the header part 275A of the object 275 on the tape 50 while conveying the tape 50 downstream, as illustrated FIG. 15B (S51: YES, S152: YES, S154: YES, and S53 in FIG. 12). More specifically, the header part 275A is printed on the portion upstream of the portion in which the header part 274A (the specific header part in Job(1)) is already printed at the start time of Job(2). The object 275 is an example of the claimed "second object." The header part 275A is an example of the claimed "second header part." The print date "19/01/10" included in the header part 275A is an example of the claimed "second print date." The portion in which the header part 275B has been printed is an example of the claimed "third portion."

At the timing that printing of the header part 275A is completed, the upstream end of the portion of the tape 50 in which the header part 274A has been printed and the downstream end of the portion of the tape 50 in which the header part 275A has been printed (hereinafter called a border area 285 between the header part 274A and header part 275A) are aligned with the position of the cutting part 17. Accordingly, the printing device 1 halts conveyance of the tape 50 and controls the cutting part 17 to perform a full cut at the border area 285 of the tape 50. These operations cut off the portion of the tape 50 in which the unnecessary header part 274A has been printed from the tape cassette 30, as illustrated in FIG. 15C.

After cutting the border area 285, as illustrated in FIG. 15D, the printing device 1 resumes conveying the tape 50 downstream and heats the thermal head 10 to print a body part 275B of the object 275 on the tape 50 (S55 in FIG. 12). More specifically, the body part 275B is printed on the portion upstream of the portion in which the header part 275A has been printed. The body part 275B is an example of the claimed "second body part."

Figures 16A, 16B, 16C, 16D:
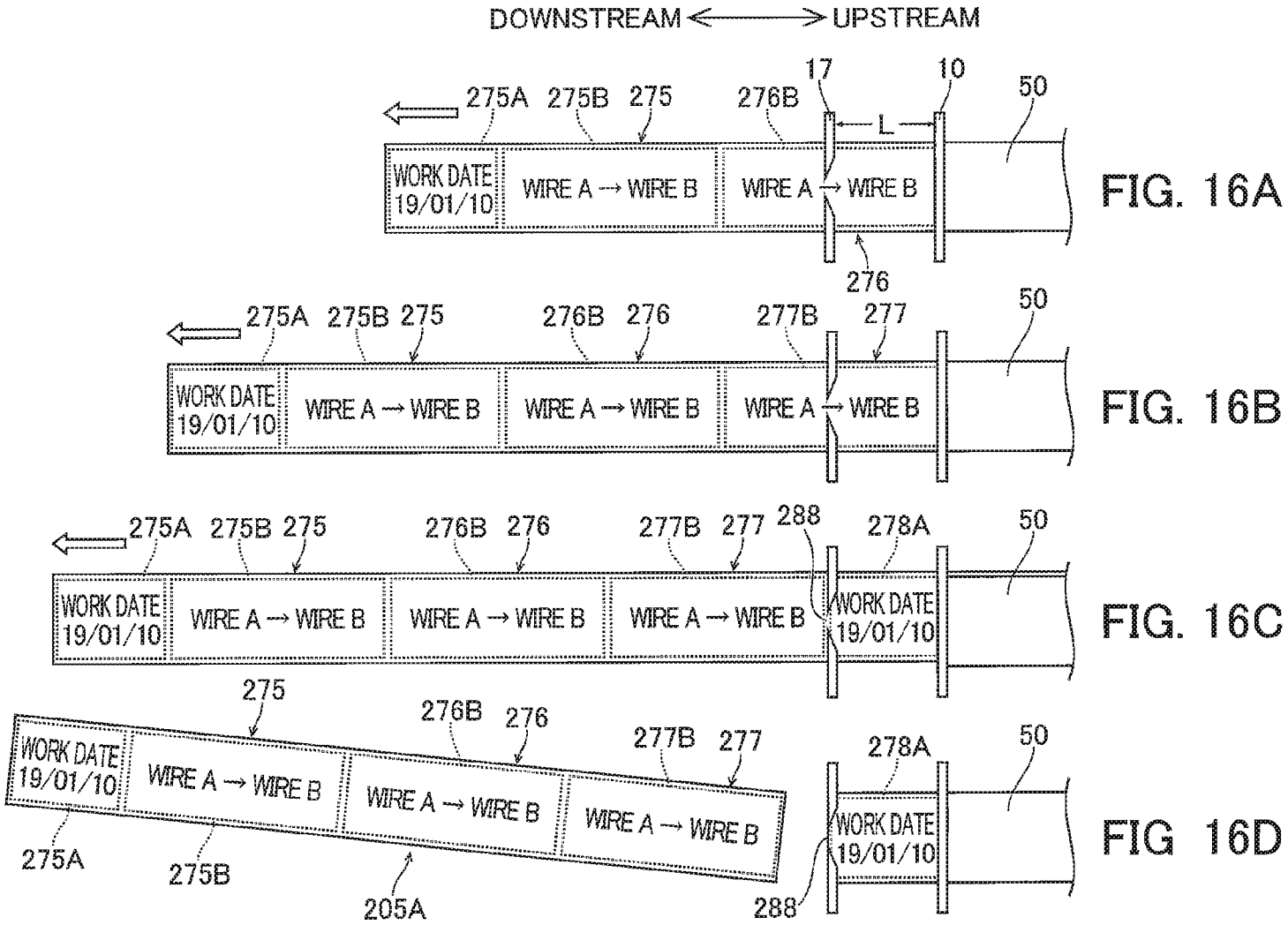
FIG. 16A is a view for describing the second example of the label creating method in the printing device 1 according to the modification, and illustrates a state in which printing of a body part 276B is completed.
FIG. 16B is a view for describing the second example of the label creating method in the printing device 1 according to the modification, and illustrates a state in which printing of a body part 277B is completed.
FIG. 16C is a view for describing the second example of the label creating method in the printing device 1 according to the modification, and illustrates a state in which printing of a header part 278A (i.e., a specific header part) is completed and a border area 288 between the body part 277B and the header part 278A is aligned with the cutting part 17.
FIG. 16D is a view for describing the second example of the label creating method in the printing device 1 according to the modification, and illustrates a state in which cutting of the border area 288 is completed.

After completing printing of the body part 275B, as shown in FIG. 16A, the printing device 1 heats the thermal head 10 and continues to convey the tape 50 downstream to print a body part 276B of the next object 276 on the tape 50 without printing a header part 7A of the next object 276 (S51: YES, S152: YES, S154: NO and S55 in FIG. 12). More specifically, the body part 276B is printed on the portion upstream of the portion in which the body part 275B has been printed. That is, the body part 276B is printed on the portion upstream of the portion in which the object 275 has been printed. Note that, since the object 276 is to be printed second in Job(2), the header part 7A of the object 276 is not printed despite the fact that the CPU 91 determines in S51 of FIG. 12 that printing of the header part 7 is necessary. Further, although a border area between the body part 275B and the body part 276B is not cut in this example, a full cut or a half cut may be performed at the border area between the body part 275B and the body part 276B.

After completing printing of the body part 276B, as shown in FIG. 16B, the printing device 1 heats the thermal head 10 and continues to convey the tape 50 downstream to print a body part 277B of the last object 277 on the tape 50 without printing a header part 7A of the last object 277 (S51: YES, S152: YES, S154: NO and S55 in FIG. 12). More specifically, the body part 277B is printed on the portion upstream of the portion in which the body part 276B has been printed. That is, the body part 277B is printed on the portion upstream of the portion in which the object 276 has been printed. Note that, since the object 277 is to be printed last in Job(2), the header part 7A of the last object 277 is not printed despite the fact that the CPU 91 determines in S51 of FIG. 12 that printing of the header part 7A is necessary. Further, although a border area between the body part 276B and the body part 277B is not cut in this example, a full cut or a half cut may be performed at the border area between the body part 276B and the body part 2771. The object 277 is an example of the claimed "first object." The header part 7A of the object 277 is an example of the claimed "first header part." The print date "19/01/10" included in the header part 7A of the object 277 is an example of the claimed "first print date." The body part 277B is an example of the claimed "first body part." The body part 277B is an example of the claimed "first body part." The portion in which the body part 277B has been printed is an example of the claimed "first portion."

After completing printing of the body part 277B, as shown in FIG. 16C, the printing device 1 heats the thermal head 10 and continues to convey the tape 50 downstream to print a header part 278A (i.e., the specific header part for Job(2)) (S57: YES and S59 in FIG. 12). More specifically, the header part 278A is printed on the portion upstream of the portion in which the body part 277B has been printed. That is, the header part 278A, i.e., the specific header part for Job (2) is printed on the portion upstream of the portion in which the last object 277 has been printed. The header part 278A is an example of the claimed "specific header part." The portion in which the header part 278A has been printed is an example of the claimed "second portion."

At the timing that printing of the header part 278A is completed, the upstream end of the portion of the tape 50 in which the body part 277B of the object 277 has been printed and the downstream end of the portion of the tape 50 in which the header part 278A has been printed (hereinafter called a border area 288 between the body part 277B and header part 278A) are aligned with the position of the cutting part 17 as shown in FIG. 16C. Here, the printing device 1 halts conveyance of the tape 50 and controls the cutting part 17 to perform a full cut at the border area 288 of the tape 50, thereby ending Job(2). Through this action, the portion of the tape 50 in which the objects 275, 276, and 277 have been printed is cut off from the tape cassette 30, and the header part 278A (i.e., the specific header part for Job(2)) is left between the thermal head 10 and the cutting part 17, as illustrated in FIG. 16D. These operations create a label 205A in which the objects 275, 276, and 277 have been printed. Note that, although a full cut is performed at the border area 288 in this example, a half cut may be performed at the border area 288 instead of the full cut.

As described above, the printing device 1 according to the present modification can create a label (such as the labels 105A and 205A) having only one header part printed at the head of the label. Therefore, the present modification can meet needs of users which wish to create a label in which only one header part is printed at the head of the label.

<Other Modifications>

While the present embodiment and the modification thereof have been described in detail, it would be apparent to those skilled in the art that many modifications and variations may be made thereto. While the printing method employed in the printing device 1 is the thermal transfer method, the printing device 1 may employ a different printing method, such as a direct thermal method, an inkjet method, or an electrophotographic method. The cutting part 17 of the printing device 1 may possess only the full cutting function and need not possess a half cutting function. The tape cassette 30 may be a laminating-type cassette in which a film is bonded to the printed tape 50.

The CPU 91 may perform a half cut instead of a full cut on the tape 50 in S65 of the cutting process. In other words, in FIGS. 7A through 7F, the CPU 91 need not cut off the portion of the tape 50 on which the header part 74A is printed from the portion in which the object 76 is printed, but may leave these portions connected by the release paper. This method prevents the portion of the tape 50 in which the header part 74A is printed from becoming cut off from the portion in which the object 76 is printed, saving the user the time and effort required to discard a portion cut off from the tape 50.

In S31 of the setup process, the CPU 91 may determine whether to perform a full cut with the cutting part 17 at the border area between the header part and the body part. When the CPU 91 determines that a full cut is to be performed (S31: YES), in S71 of the cutting process, the CPU 91 may perform a full cut at the border area between the header part and the body part.

The information included in the header part is not limited to the print date, but may include other information. For example, the header part may also include a company name and logo, a username, a print time, and the like. Alternatively, the header part may include only information other than the print date. Further, the header part may include a print date and time, instead of the print date.

What is claimed is:

1. A printing device comprising:

a conveying portion configured to convey a printing medium along a conveying path in a conveying direction;

a printing portion configured to print objects on the printing medium conveyed along the conveying path in the conveying direction by the conveying portion;

a cutting portion configured to cut the printing medium, the cutting portion being separated from the printing portion, the cutting portion being disposed downstream of the printing portion in the conveying direction; and a controller configured to perform:

acquiring a first object including a first header part and a first body part;

printing, using the printing portion, the first body part on a first portion of the printing medium;

after completing the printing the first body part, conveying, using the conveying portion, the printing medium until an upstream end of the first portion in the conveying direction reaches the cutting portion;

while performing the conveying the printing medium, printing, using the printing portion, a specific header part on a second portion of the printing medium, the specific header part being the same as the first header part, the second portion being positioned upstream of the first portion in the conveying direction;

after completing the printing the specific header part, acquiring a second object including a second header part and a second body part;

determining whether the first header part and the second header part match each other;

in response to determining that the first header part and the second header part do not match, printing, using the printing portion, the second header part on a third portion of the printing medium, the third portion being positioned upstream of the second portion in the conveying direction; and cutting, using the cutting portion, an upstream end of the second portion in the conveying direction; and in response to determining that the first header part and the second header part match each other, printing, using the printing portion, the second body part on the third portion of the printing medium without printing the second header part.

2. The printing device according to claim 1, wherein, in the cutting the upstream end of the second portion, the controller controls the cutting portion to perform a full cut at the upstream end of the second portion in the conveying direction.

3. The printing device according to claim 1, wherein, in the cutting the upstream end of the second portion, the controller controls the cutting portion to perform a half cut at the upstream end of the second portion in the conveying direction.

4. The printing device according to claim 1, wherein the controller is configured to further perform:

determining whether to cut a border area between a portion in which the second header part is printed and a portion in which the second body part is printed; and in response to determining to cut the border area, controlling the cutting portion to perform a half cut at the border area.

5. The printing device according to claim 1, wherein the first header part includes a first print date on which the first header part is printed, wherein the second header part includes a second print date on which the second header part is printed, and wherein, in the determining whether the first header part and the second header part match each other, the controller determines whether the first print date and the second print date match each other.

* * * * *